US006892782B1

(12) United States Patent
Mayle

(10) Patent No.: US 6,892,782 B1
(45) Date of Patent: May 17, 2005

(54) APPARATUS AND METHOD FOR SEALING A VERTICAL PROTRUSION ON A ROOF

(76) Inventor: Steven R. Mayle, 2274 Augusta Dr., Fremont, OH (US) 43420

( * ) Notice: Subject to any disclaimer, the term of this patent is extended or adjusted under 35 U.S.C. 154(b) by 108 days.

(21) Appl. No.: 10/374,688

(22) Filed: Feb. 26, 2003

Related U.S. Application Data

(63) Continuation of application No. 10/124,931, filed on Apr. 18, 2002.
(60) Provisional application No. 60/353,251, filed on Feb. 1, 2002.

(51) Int. Cl.[7] ..... B30B 15/34
(52) U.S. Cl. ..... 156/581; 156/583.1
(58) Field of Search ..... 156/540, 541, 156/542, 556, 580, 581, 583.1; 100/315, 211, 295

(56) References Cited

U.S. PATENT DOCUMENTS

| | | | | |
|---|---|---|---|---|
| 322,153 | A | 7/1885 | Blair et al. | 52/746.11 X |
| 549,352 | A | 11/1895 | Folger | 285/43 |
| 821,426 | A | 5/1906 | Meyer | 24/280 |
| 835,889 | A | 11/1906 | Moeller | 52/521 |
| 1,012,219 | A | 12/1911 | Overton | 285/42 |
| 1,031,577 | A | 7/1912 | Overton | 285/42 |

(Continued)

FOREIGN PATENT DOCUMENTS

| | | |
|---|---|---|
| CH | 221530 | 6/1942 |
| DE | 3321101 | 12/1983 |
| GB | 1 310 003 | 1/1971 |
| GB | 1 355 517 | 5/1971 |
| GB | 1 511 729 | 10/1975 |
| JP | 49-002675 | 1/1974 |

OTHER PUBLICATIONS

GenFlex Product Details for Field Fabricated Outside Corner.
Technical product literature from Duro–Last, Inc.
GenFlex Roofing Systems, pp. 17 and 21, Apr. 2001, see: http://222.genflex.com.
General Tire Building Products Company, The General Tire and Rubber Company, Field Fabricated Pipe Boot, Jun. 1, 1983.
GTR Building Products Company, The General Tire and Rubber Company, GenSeal ACR Roofing System Roof Pipe Penetration.
Prior Art picture, Duro–Last stack with lap weld.
Prior Art picture, Duro–Last stack with buH weld.
Prior Art picture, Duro–Last corner.
Prior Art picture, Custom Seal corner piece.
Alkor Single Ply Roofing Systems brochure.
GTR Building and Products Company, The General Tire and Rubber Company, GenSeal ACR Roofing System Roof Pipe Penetration spec sheet.

(Continued)

*Primary Examiner*—James Sells
(74) *Attorney, Agent, or Firm*—Standley Law Group LLP

(57) ABSTRACT

A boot provides a water-tight seal around a protrusion on a roof. A top portion thereof surrounds a predetermined portion of the protrusion. A bottom end thereof has a bottom opening and a horizontally flat bottom edge. The top portion may form the boot alone or in combination with a base portion that is connected to the bottom edge. The top portion extends substantially vertically when the base portion resides on the roof. The boot may be open to allow installation on existing protrusions. A top end of the top portion may have a slit running vertically down a predetermined distance thereof to allow the top opening to be adjusted around the protrusion. The boot is installed by placing the bottom opening over the protrusion with the base portion substantially flat on the roof. The top opening is pulled into a fit and sealed around the protrusion.

19 Claims, 24 Drawing Sheets

U.S. PATENT DOCUMENTS

| | | | | |
|---|---|---|---|---|
| 1,080,159 | A | 12/1913 | Overton | 285/42 |
| 1,103,666 | A | 7/1914 | Fife | 285/42 |
| 1,163,034 | A | 12/1915 | Phippen | 52/551 |
| 1,195,338 | A | 8/1916 | Churchill | 285/44 |
| 1,202,687 | A | 10/1916 | Elkerton | 285/13 |
| 1,540,192 | A | 6/1925 | Smith | 285/13 |
| 1,594,932 | A | 8/1926 | Doyle | 285/42 |
| 1,678,715 | A | 7/1928 | Stephenson | 285/42 |
| 1,721,715 | A | 7/1929 | Schindler | 285/42 |
| 1,923,220 | A | 8/1933 | Lightbown | 285/13 |
| 2,069,289 | A | 2/1937 | Swendsen et al. | 52/288.1 |
| 2,151,794 | A | 3/1939 | Peebles | 52/553 X |
| 2,176,344 | A | 10/1939 | Hunt | 52/551 |
| 2,256,313 | A | 9/1941 | Dexter | 52/551 |
| 3,040,154 | A | 6/1962 | Marsh | 156/539 |
| 3,054,222 | A | 9/1962 | Buckner | 52/543 |
| 3,325,953 | A | 6/1967 | Alleaume | 52/276 |
| 3,446,685 | A | 5/1969 | Goldstone et al. | 156/219 |
| 3,446,688 | A | 5/1969 | Flax | 156/423 |
| 3,451,178 | A | 6/1969 | Beale | 52/210 |
| 3,566,562 | A | 3/1971 | White | 52/748.1 X |
| 3,763,605 | A | 10/1973 | Freeman | 52/58 |
| 3,871,145 | A | 3/1975 | Hatmaker | 285/42 |
| 3,887,323 | A | 6/1975 | Bratten | 425/521 |
| 3,890,754 | A | 6/1975 | Spurdle | 52/631 |
| 3,894,376 | A | 7/1975 | Shearer | 52/518 |
| 3,942,295 | A | 3/1976 | Schacht | 52/288 |
| 4,049,034 | A | 9/1977 | Vcelka et al. | 150/8 |
| 4,112,632 | A | 9/1978 | Simpson | 52/11 |
| 4,115,961 | A | 9/1978 | Bishop | 52/58 |
| 4,120,129 | A | 10/1978 | Nagler et al. | 52/219 |
| 4,162,597 | A | 7/1979 | Kelly | 52/410 |
| 4,192,116 | A | 3/1980 | Kelly | 52/469 |
| 4,217,742 | A | 8/1980 | Evans | 52/553 |
| 4,223,486 | A | 9/1980 | Kelly | 52/1 |
| 4,226,069 | A | 10/1980 | Hinds | 52/521 |
| 4,265,058 | A | 5/1981 | Logsdon | 52/58 |
| 4,302,275 | A | 11/1981 | Burmeister et al. | 156/446 |
| 4,335,546 | A | 6/1982 | Kelly | 52/58 |
| 4,351,140 | A | 9/1982 | Simpson | 52/542 |
| 4,374,695 | A | 2/1983 | Ikeda et al. | 156/293 |
| 4,382,353 | A | 5/1983 | Kelly | 52/506 |
| 4,386,488 | A | 6/1983 | Gibbs | 52/199 |
| 4,389,826 | A | 6/1983 | Kelly | 52/410 |
| 4,419,067 | A | 12/1983 | Graafmann | 425/392 |
| 4,441,295 | A | 4/1984 | Kelly | 52/408 |
| 4,446,665 | A | 5/1984 | Berger | 52/407 |
| 4,449,336 | A | 5/1984 | Kelly | 52/105 |
| 4,493,175 | A | 1/1985 | Coppola, Jr. | 52/410 |
| 4,496,410 | A | 1/1985 | Davis et al. | 156/84 |
| 4,544,593 | A | 10/1985 | Borgert et al. | 428/80 |
| 4,555,296 | A | 11/1985 | Burtch et al. | 156/446 |
| 4,557,081 | A | 12/1985 | Kelly | 52/94 |
| 4,603,517 | A | 8/1986 | Lyons, Jr. | 52/60 |
| 4,625,469 | A | 12/1986 | Gentry et al. | 52/3 |
| 4,635,409 | A | 1/1987 | Vandemore | 52/60 |
| 4,642,950 | A | 2/1987 | Kelly | 52/90 |
| 4,652,321 | A | 3/1987 | Greko | 156/165 |
| 4,668,315 | A | 5/1987 | Brady et al. | 156/71 |
| 4,671,036 | A | 6/1987 | Sullivan | 52/518 |
| 4,688,361 | A | 8/1987 | Kelly | 52/173 R |
| 4,700,512 | A | 10/1987 | Laska | 52/58 |
| 4,712,348 | A | 12/1987 | Triplett et al. | 52/408 |
| 4,718,211 | A | 1/1988 | Russell et al. | 52/409 |
| 4,726,164 | A | 2/1988 | Reinwall et al. | 52/410 |
| 4,736,562 | A | 4/1988 | Kelly | 52/173 R |
| 4,799,986 | A | 1/1989 | Janni | 156/196 |
| 4,834,828 | A | 5/1989 | Murphy | 156/359 |
| 4,848,045 | A | 7/1989 | Nichols et al. | 52/60 |
| 4,860,514 | A | 8/1989 | Kelly | 52/410 |
| 4,870,796 | A | 10/1989 | Hart et al. | 52/409 |
| 4,872,296 | A | 10/1989 | Janni | 52/58 |
| 4,888,930 | A | 12/1989 | Kelly | 52/410 |
| 4,909,135 | A | 3/1990 | Greko | 98/42.23 |
| 4,947,614 | A | 8/1990 | Mayle | 52/717.1 |
| 4,963,219 | A | 10/1990 | Nichols et al. | 156/304.2 |
| 5,014,486 | A | 5/1991 | Mayle | 52/717.1 |
| 5,027,572 | A | 7/1991 | Purcell et al. | 52/309.9 |
| 5,031,374 | A | 7/1991 | Batch et al. | 52/58 X |
| 5,065,553 | A | 11/1991 | Magid | 52/58 |
| 5,077,943 | A | 1/1992 | McGady | 52/58 |
| 5,145,617 | A | 9/1992 | Hermanson et al. | 264/143 |
| 5,197,252 | A | 3/1993 | Tiscareno | 52/553 |
| 5,218,793 | A | 6/1993 | Ball | 52/62 |
| 5,300,170 | A * | 4/1994 | Donohoe | 156/235 |
| 5,365,709 | A | 11/1994 | Lassiter | 52/408 |
| 5,452,553 | A | 9/1995 | Clapp et al. | 52/408 |
| 5,474,134 | A * | 12/1995 | Spotzl et al. | 156/475 |
| 5,570,553 | A | 11/1996 | Balkins | 52/748.1 X |
| 5,586,414 | A | 12/1996 | Tawzer | 52/96 X |
| 5,605,019 | A | 2/1997 | Maziekien et al. | 52/58 |
| 5,706,610 | A | 1/1998 | Mayle | 52/58 |
| 5,740,647 | A | 4/1998 | Kelly | 52/408 |
| 5,775,052 | A | 7/1998 | Mayle | 52/746.11 |
| 5,829,214 | A | 11/1998 | Hart | 52/302.6 |
| 5,850,719 | A | 12/1998 | Mayle | 52/408 |
| 5,930,969 | A | 8/1999 | Mayle et al. | 52/545 |
| 5,935,357 | A | 8/1999 | Hubbard et al. | 156/82 |
| 5,983,592 | A | 11/1999 | Mayle | 52/746.11 |
| 6,004,645 | A | 12/1999 | Hubbard | 428/57 |
| 6,021,616 | A | 2/2000 | Mayle | 52/408 |
| 6,083,337 | A * | 7/2000 | Bailey et al. | 156/212 |
| 6,110,311 | A | 8/2000 | Mayle et al. | 156/189 |
| 6,187,122 | B1 | 2/2001 | Hubbard et al. | 156/82 |
| 6,189,589 | B1 * | 2/2001 | Tokunaga et al. | 156/497 |
| 6,199,326 | B1 | 3/2001 | Mayle | 52/58 |
| 6,205,730 | B1 | 3/2001 | Hasan et al. | 52/408 |
| 6,250,034 | B1 | 6/2001 | Hulsey | 52/410 |

OTHER PUBLICATIONS

GTR Building and Products Company, The General Tire and Rubber Company, Prefabricated Pipe Boot spec sheet F–3.03, Jun. 1, 1984.

i.p.w. Ĭnterplastic Ĭnteroof Roofing Systems brochure.

Johns–Manville Manual for Built–Up Roof Systems brochure, 1983.

J.P. Stevens Hi–Tuff single–ply membrane roofing system brochure.

Koppers The Roofing People brochure.

Mayle, Steve. Side elevational view of Custom Seal's corner piece fig. 7.

Mule–Hide Products Co., Inc. detail drawings MH–112 and MH–121, Feb. 1, 1993.

Owens–Corning Fiberglass PermaPly–R brochure, 1982.

Polyken Roofing Systems brochure.

Rubber & Plastics Compound Company, Inc. Single Ply Membrane Roofing brochure.

Sarnafil detail drawings 5.1—5.3, 1984.

Sarnafil Roofing Membranes brochure.

Seal–Dry/USA, inc. detail drawings 7.1, 7.2, 10.1, FA–410—FA–413, FA–604, FA–701, EQ–305—EQ–308, EQ–601—EQ–602, Jun. 1, 1994.

Seaman Corporation, Fiberlite Single Ply Roof, field fabricated pipe flashing drawing FTR–D19, Oct. 1986.

Seaman Corporation, Fiberlite Single Ply Roof, pre–formed pipe flashing drawing FTR–DP3, Jan. 1, 1996.

Siplast brochure.

Tamko Built–Up Roofing Systems brochure, 1983.

Trocal Roofing Systems brochure.
WeatherGard Single Ply Elastomeric Roofing Systems brochure.
Jan. 1, 1993, Technical product literature from Duro–Last, Inc., 1.
1986, At Last Roofing, Inc. catalog.
1983, Benoit E.P.D.M. Roofing Systems brochure.
Jul., 1988, Bond Cote Roofing Systems detail drawings, 7–5.1, 7–6, 7–6.1, 7–9.
Custom Seal detail drawings, #1–#41.
Jun., 1983, Duro–Last detail drawings, 7.10, 7.11.
Duro–Last Roofing, Inc. The Complete Roofing System.
mid–1980's, Duro–Last Roofing, Inc. Factory Mutual Systems manual.
1991–1994, Duro–Last Roofing, Inc. information manual.
Duro–Last Roofing, Inc. information manual.
Jan., 1992, Duro–Last Roofing.
1983, GAF Roofing Products brochure.
1994, GenFlex Roofing Systems detail drawings.
1982, General Tire All Climate Roofing Systems brochure.
Jun., 1983, General Tire Building and Products Company, The General Tire and Rubber Company, Field Fabricated Pipe Boot spec sheet, F–3.01.
Jun., 1984, GTR Building and Products Company, The General Tire and Rubber Company, Prefabricated Pipe Boot spec sheet, F–3.03.
1983, Johns–Manville Manual for Built–Up Roof Systems brochure.
J.P. Stevens Hi–Tuff single–ply membrane roofing systems brochure.
Koppers The Roofing People brochure.
Mayle, Steve, Side elevational view of Custom Seal's corner piece, Fig. 7.
Feb., 1993, Mule–Hide Products Co., Inc. detail drawings, MH–112, MH–121.
1982, Owens–Corning Fiberglass PermaPly—R brochure.
Rubber and Plastics Company, Inc. Ingle Ply Membrane Roofing brochure.
1984, Sarnafil dtail drawings, 5.1–5.3.
Jun., 1994, Seal–Dry/USA, Inc. detail drawings.
Oct., 1986, Seaman Corp. Fiberlite Single Ply Roof field fabricated pipe flashing drawing, FTR–D19.
Jan., 1996, Seaman Corp. Fiberlite Single Ply Roof, pre–formed pipe flashing drawing, FTR–DP3.
1983, Tamko Built–Up Roofing Systems brochure.
WeatherGuard Single Ply Elastomeric Roofing Systems brochure.

* cited by examiner

FIG-8
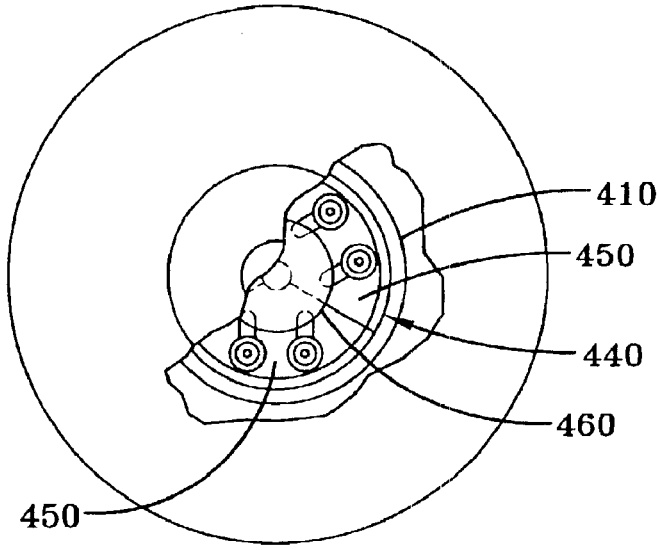
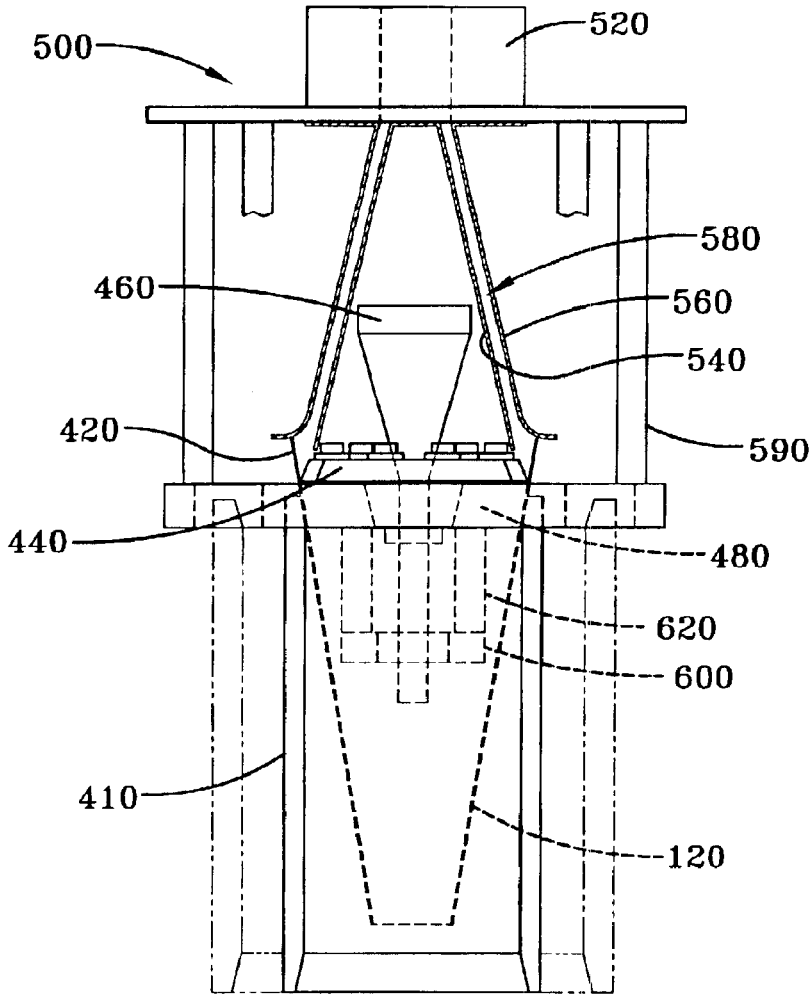
FIG-7

APPARATUS AND METHOD FOR SEALING A VERTICAL PROTRUSION ON A ROOF

This application is a continuation of U.S. patent application Ser. No. 10/124,931, filed Apr. 18, 2002 claiming priority of U.S. Provisional Application No. 60/353,251, filed Feb. 1, 2002, which is hereby incorporated by reference in its entirety.

BACKGROUND AND SUMMARY OF THE INVENTION

The present invention relates generally to roof-covering devices, and more particularly to a boot for covering and providing a water-tight seal around a protrusion on a roof.

Polymer coated membranes are commonly used to cover roofs. Often, the membrane is custom designed for the particular roof on which it is used. The roof measurements are provided to the factory which creates a unitary membrane from separate pieces which have been heat welded together.

Although these roofs are generally flat, there are frequently items protruding from the surface of the roof, such as vents, ductwork, air conditioning units, and the like. The size of these items should be provided to the factory so that accommodations can be made for them in the membrane. Locations of these items at certain points on the roof may also be provided to the factory.

The present invention specifically relates to a boot for covering and sealing a vertical protrusion (e.g., pipe) extending from a roof to be sealed. As discussed, when installing a roof membrane, it is desirable to provide a water-tight seal around protrusions in a roof. Typically, when installing a boot around a protruding pipe, generally three seals are made to provide a water-tight seal around the pipe:

1.) a base portion of the boot should be sealed to a top portion of the boot (e.g. hot air sealed, welded, glued, or caulked);

2.) the base portion should be sealed to the roof or a roof membrane that may be formed of the same or similar material as the base portion, or another material that may be heat bonded or otherwise sealed with the base portion in a leak proof manner (e.g. hot air sealed, welded, glued, or caulked); and 3.) a top end of the top portion of the boot should be sealed around the pipe to prevent water from entering any space between the boot and the pipe.

Currently this process of sealing a protruding pipe takes a relatively long time and can result in a poor seal. Accordingly, the present invention relates to a new method and apparatus for sealing vertical protrusions on a roof allowing the boot of the present invention to be relatively easily installed and adjusted to provide a tight seal for protruding pipes.

The boot of the present invention may be preferably comprised of: a top portion adapted to surround a predetermined portion of the protrusion (e.g., pipe) to be covered, the top portion having a top end and a bottom end, wherein the top end has a top opening and wherein the bottom end has a bottom opening; a base portion, wherein the base portion may be connected to a bottom edge of the top portion and wherein the top portion may extend substantially in the vertical direction when the base portion resides on the roof. It is also preferred that the bottom opening of the boot be adapted to accept a protrusion (e.g., pipe) to be covered. In an exemplary embodiment, the top end of the top portion may have a slit, the slit running vertically down a predetermined distance of the top portion of the boot and wherein the slit allows the top opening of the top portion to be adjusted in size to fit around various sizes of pipe to be sealed.

In another exemplary embodiment of the present invention, the top portion may be used without a base in certain situations.

The boot of the present invention may preferably be formed by: providing a first piece of material having a first side edge and a second side edge; forming a top portion having a bottom opening and top opening and a slit portion at a top end of the top portion, said top portion formed by sealing a bottom portion of the first side edge to a corresponding bottom portion of the second side edge; heating and then compressing the bottom edge of the top portion so that the bottom edge turns horizontally outward forming a flat horizontal circumference around the entire bottom of the top portion; providing a base portion; and sealing a bottom edge of the top portion with the base portion so that the top portion may be substantially vertical with respect to the base portion when the base is in the flat horizontal position.

In one embodiment, the bottom edge of the top portion may be folded and positioned around the edge or perimeter of the opening in the base portion. The bottom edge of the top portion may then be welded to the base portion to form a weld that may be substantially flat on the same plane as the base portion. This weld allows the base portion to lay substantially flat during the welding process obviating the need to deform the edge of the base opening to accomplish the weld. In this embodiment, the bottom edge of the top portion may overlap the perimeter of the opening of the base portion or the perimeter of the opening of the base portion may overlap the bottom edge of the top portion when welded.

In an alternative embodiment, the edge of the base portion may be folded up to make a lapped engagement with the vertical portion of the top portion. Accordingly, a weld may be made along the substantially flat base portion as well as the vertical top portion to provide a strong seal (i.e., welded).

In yet another embodiment, the top portion may be used without a base. Particularly, when the bottom edge of the top portion is turned out with a sufficient width that a seal may be formed with the roof or roofing membrane, then a base may not be needed. In this embodiment, the bottom edge may be of such a sufficient width that it may serve as a base. Top portions may be sized at the factory to fit particular sizes of pipes on roofs, or the top portions may comprise a slit near their top for adjustments to fit different sizes of pipes.

The boot may then be installed by: placing the bottom opening of the top portion over a protrusion to be covered; placing the base portion (if it has a base portion) flat over the roof; pulling a top portion of a side edge of the vertical portion around the protrusion (e.g., pipe) so that the top opening of the top portion may be adjusted to fit the protrusion; sealing the top opening of the top portion around the protrusion; and sealing the base portion to the roof or roofing membrane. If an embodiment is used without a base, the bottom edge of the top portion that has been turned out to a sufficient width may be sealed directly to the roof or roofing membrane.

In another open boot flashing embodiment, the flashing may be open to allow the flashing or "stack" to be wrapped around the protrusion to be covered. After wrapping the protrusion, the top and base portions are welded to complete the seal. The open flashing may preferably be comprised of:

a base portion having an opening; a top portion attached to the base portion along the opening in the base portion; a break in the base portion and the top portion, the break in the base portion separating a first portion of the base portion from a second portion of the base portion, and wherein the break in the top portion separates a first portion of the top portion from a second portion of the top portion; and wherein the break allows the apparatus to be opened to accept a protrusion on the roof to be covered and wherein the first portions of the base portion and the top portion may be pulled around the protrusion and sealed to the second portions of the base portion and top portion, respectively. The first portions of the base portion and top portion may be adjustably pulled around the protrusion to accommodate protrusions of various sizes.

In one embodiment, the bottom edge of the top portion may be folded and positioned around the edge or perimeter of the opening in the base portion. The bottom edge of the top portion may then be welded to the base portion to form a weld that may be substantially flat on the same plane as the base portion. This weld allows the base portion to lay substantially flat during the welding process obviating the need to deform the edge of the base opening to accomplish the weld. In this embodiment, the bottom edge of the top portion may overlap the perimeter of the opening of the base portion or the perimeter of the opening of the base portion may overlap the bottom edge of the top portion when welded.

In an alternative embodiment, the interior edge of the base portion may be folded vertically straight up to make a lapped engagement with the vertical wall of the top portion. Accordingly, a weld may be made along the overlapped portions to provide a strong weld.

A flat edge having sufficient width formed at the bottom of the top portion may be formed by placing the top portion into a die, with a portion of the material sticking out. A seal forming cone and handle may be inserted into the top portion. This material sticking out above the die may then be heated for a sufficient time to disrupt the molecules in the material, thereby allowing the material to expand. The handle may then be placed in its locking position, extending the members that may resemble pie sections of the seal forming cone and pushing the material outward so that a horizontally flat circumference (i.e. bottom edge with sufficient width) may be formed.

In addition to the novel features and advantages mentioned above, other objects and advantages of the present invention will become readily apparent to those skilled in the art from reading the following detailed description of the drawings and exemplary embodiments.

BRIEF DESCRIPTION OF THE DRAWINGS

FIG. 7 illustrates a side view of an exemplary embodiment of the device used in the method of making the bottom edge of the boot of the present invention.

FIG. 8 illustrates a top view of a die showing three different die sections of the device of FIG. 7.

DESCRIPTION OF PREFERRED EMBODIMENT (S)

The exemplary systems herein described are not intended to be exhaustive or to limit the invention to the precise forms disclosed. They are chosen and described to explain the principles of the invention, and the application of the method to practical uses, so that others skilled in the art may practice the invention.

U.S. patent application Ser. No. 09/759,698 is incorporated by reference herein.

Figure 1:
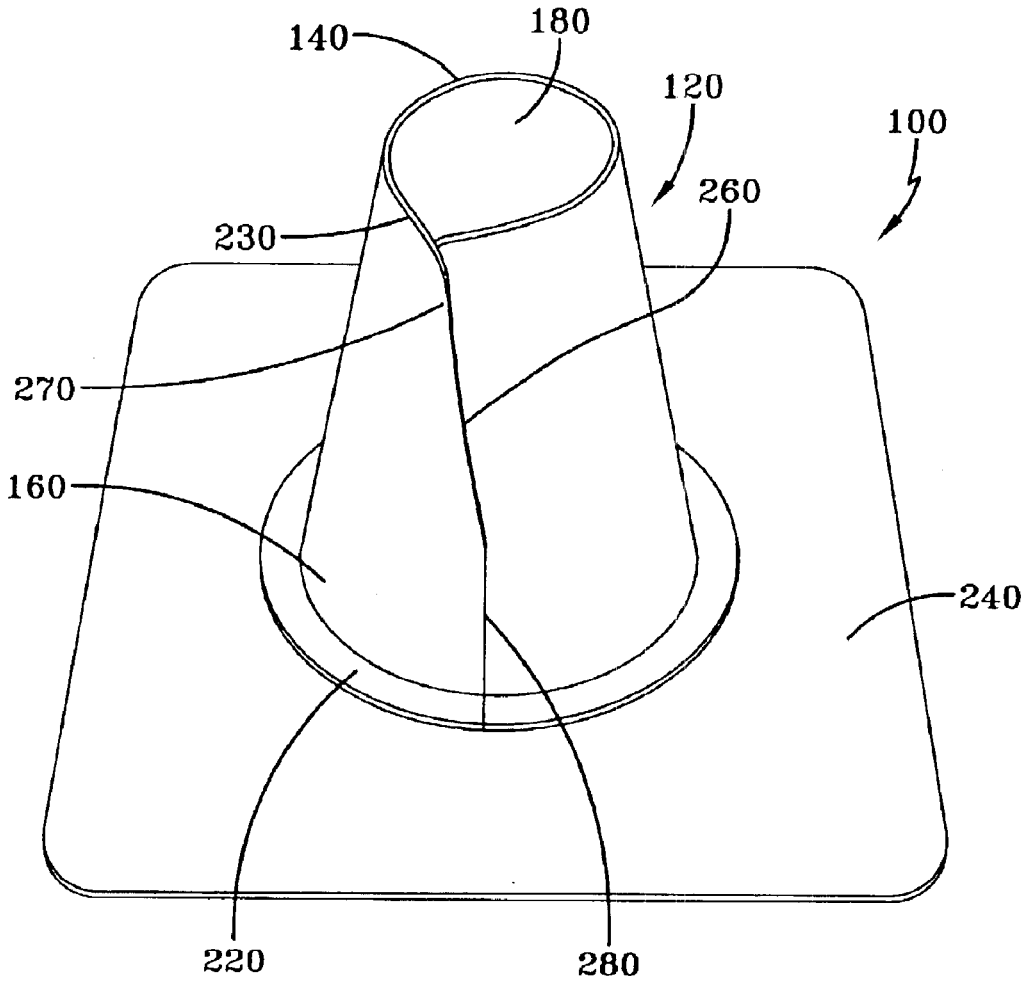
FIG. 1 illustrates a perspective view of one embodiment of the boot of the present invention.

FIG. 1 illustrates one embodiment of the boot 100 of the present invention. In an exemplary embodiment, the boot 100 of the present invention may be adapted to seal protrusions, such as pipes, on a roof. In an exemplary embodiment, the boot of the present invention may be comprised of:

- a top portion 120 adapted to surround a predetermined portion of a protrusion (e.g., pipe) to be covered, the top portion 120 having a top end 140 and a bottom end 160, wherein the top end 140 has a top opening 180 and wherein the bottom end 160 has a bottom opening 200 (see FIG. 3*a*); and
- a base portion 240, wherein the base portion 240 may be connected to a bottom edge 220 of the top portion 120 and wherein the top portion 120 extends substantially in the vertical direction when the base portion 240 resides on the roof.

In one embodiment, the bottom edge 220 of the top portion 120 may also be folded and positioned around the edge or perimeter of an opening 400 (see FIG. 4) in the base portion 240. The bottom edge 220 of the top portion 120 may then be welded to the base portion 240 around the opening 400 to form a weld that may be substantially flat on the same plane as the base portion 240. This weld allows the base portion 240 to lay substantially flat during the welding process obviating the need to deform the edge 405 (see FIG. 4) of the base opening 400 to accomplish the weld.

In an alternative embodiment, the edge 405 of the base opening 400 may be folded up to make a lapped engagement with the vertical wall of the top portion. Accordingly, a weld may be made along the overlapped material to provide a strong leak-proof seal.

In an exemplary embodiment, the top end 140 of the top portion 120 may have a slit 260 (not welded at the factory), the slit 260 running vertically down a predetermined distance of the top portion 120 of the boot 100 and wherein the slit 260 allows the top opening 180 of the top portion 120 to be adjusted in size to fit around the protrusion (e.g., pipe) to be covered. It is preferred that the slit 260 extend about 2 inches from a top edge 230 of the top portion 120 to allow flexibility for the top opening 180 to be adjusted in size. The top opening 180 may be made smaller by pulling the "flap" portion 270 of the top portion 120 around the pipe. ("Flap" in this instance merely refers to an overlapping section 270 of the top portion 120 that is not sealed at the factory.)

Figure 2:
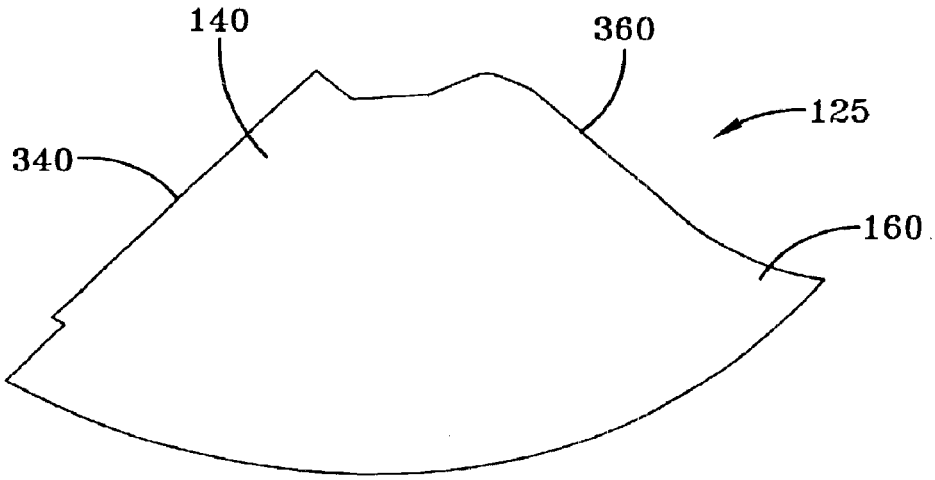
FIG. 2 illustrates a perspective view of one embodiment of an unassembled top portion of the boot of FIG. 1.

FIG. 2 illustrates one embodiment of a material blank 125 used to form the top portion 120 of the boot 100 of FIG. 1. The material blank 125 may have a first side edge 340 and a second side edge 360. A conical shaped top portion 120 may be formed from the unassembled top portion 320 when the first side edge 340 and the second side edge 360 are sealed together (see FIG. 3*a*). In an exemplary embodiment, the first side edge 340 may be heat welded to the second side edge 360 forming a heat welded section 280 on the assembled top portion 120. The first and second side edges 340, 360 of the top portion 120 may be heat welded along a predetermined portion of the bottom end 160 of the top portion 120, whereafter the unattached sections of the first and second side edges 340, 360 form the slit 260. The bottom circumference of the top portion 120 may then be heated, thereby expanding the molecules of the material, and expanding the material itself, thereby forming a bottom edge 220 that may be substantially perpendicular to the axis of the conical shaped top portion 120.

Figure 3A:
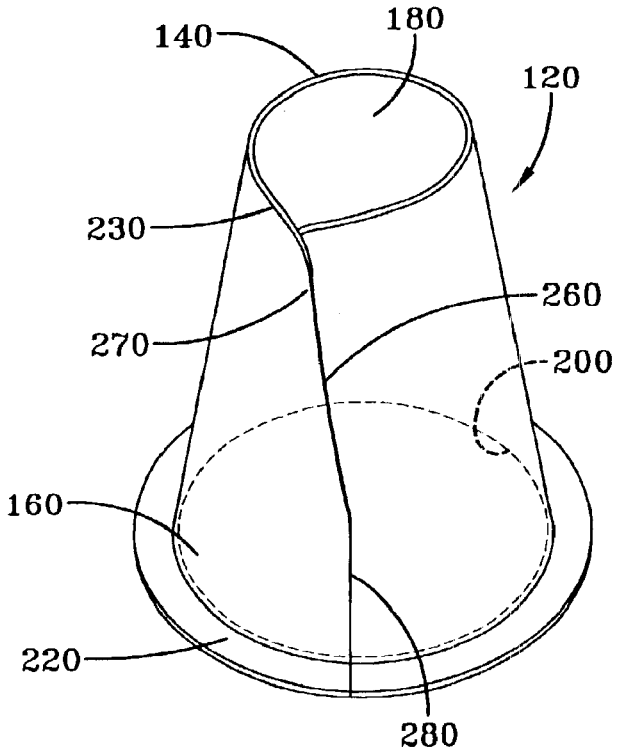
FIG. 3*a* illustrates a perspective view of one embodiment of an assembled top portion of the boot of FIG. 1.
Figure 3B:
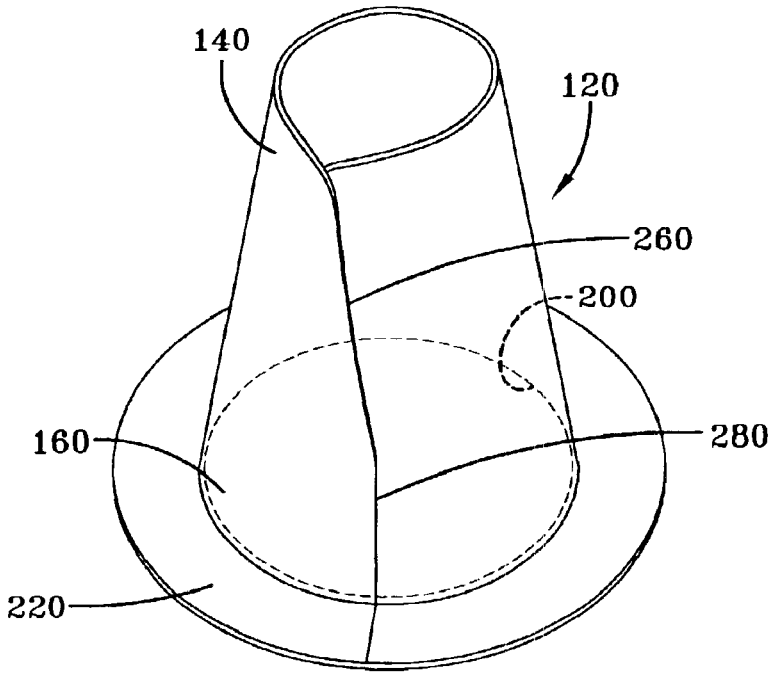
FIG. 3*b* illustrate a perspective view of one embodiment of an assembled top portion of the boot of FIG. 1 having a bottom edge of a greater width, which may also be used without a base portion.

FIGS. 3*a* and 3*b* illustrate embodiments of an assembled top portion 120 of the boot of FIG. 1. As the top portion 120 may be cone shaped, the top opening 180 may be smaller than the bottom opening 200. However, in another embodiment, the top portion 120 may be substantially cylindrical in shape, whereby the top opening 180 and the bottom opening 200 may be substantially similar in size.

Figure 4:
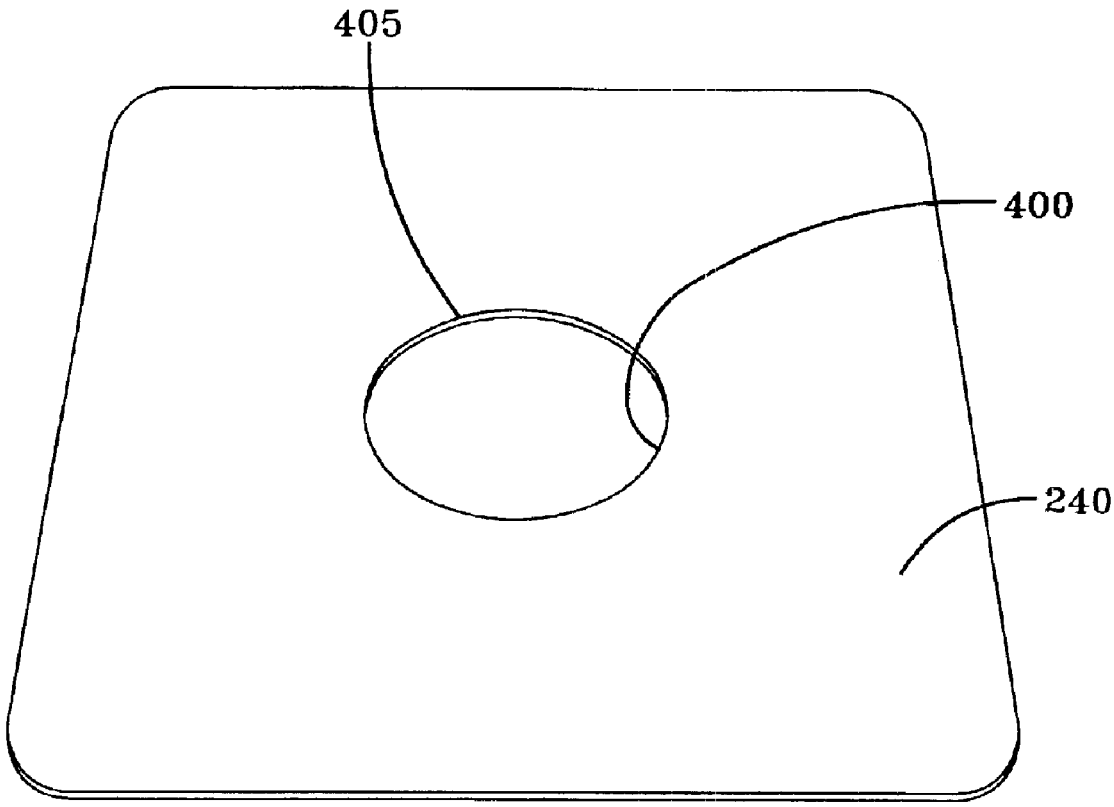
FIG. 4 illustrates a perspective view of one embodiment of a base portion of the boot of FIG. 1.
Figure 5A:
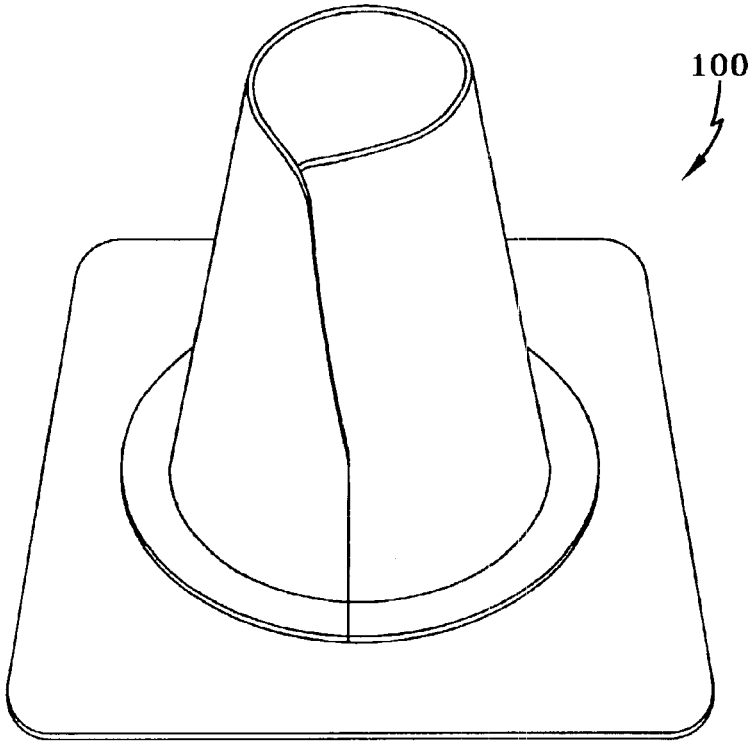
FIG. 5*a* illustrates a perspective view of another embodiment of the boot of the present invention, where the bottom edge of the top portion overlays the base.
Figure 5B:
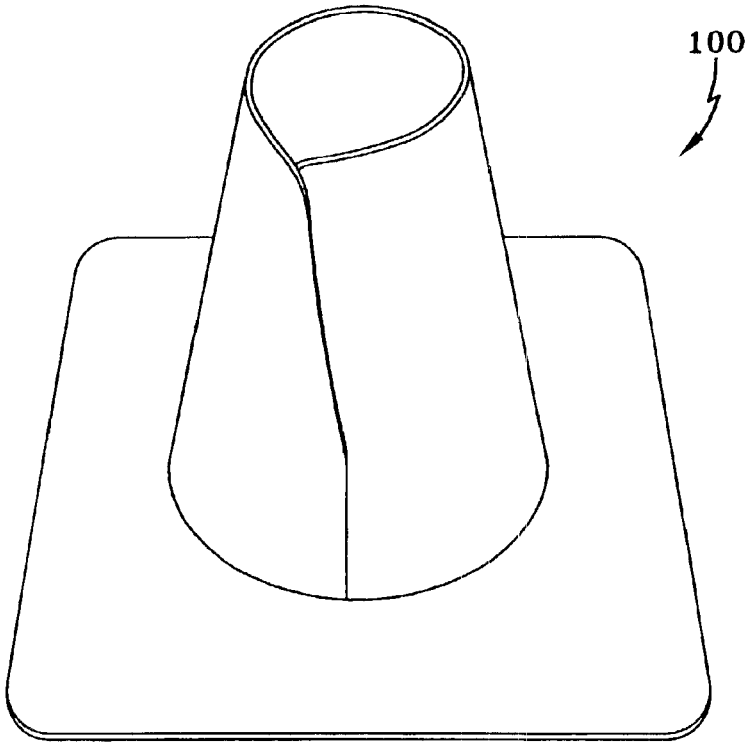
FIG. 5*b* illustrates a perspective view of another embodiment of the boot of the present invention, where the base portion overlays the bottom edge of the top portion.

FIG. 4 illustrates one embodiment of a base portion 240 of the boot 100 of FIG. 1. In an exemplary embodiment, the base portion 240 may be heat welded to the bottom edge 220 of the top portion 120. The base portion 240 and top portion 120 may be formed together using dies (e.g. female and male counterpart dies where the male part may be a cylindrical shaped piece for forming the top portion 120 around the base portion 240). In this embodiment, the bottom edge 220 of the top portion 120 may overlap the perimeter of the opening 400 of the base portion 240 or the perimeter of the opening 400 of the base portion 240 may overlap the bottom edge 220 of the top portion 120 when welded, as shown in FIGS. 5*a* and 5*b*, respectively.

The boot 100 of the present invention may preferably be made by first providing a material blank 125 for forming the top portion 120, the material blank 125 having a first side edge 340 and a second side edge 360. The top portion 120 may be formed by sealing a bottom portion of the first side edge 340 to a corresponding bottom portion of the second side edge 360. This seal is shown at 280. The top portion 120 may have a slit 260 at a top end 140 of the top portion 120 and a bottom and top opening 180, 200. In an exemplary embodiment of the boot 100, the top portion 120 may be conical in shape. In another exemplary embodiment of the boot 100, the top portion 120 may be cylindrical in shape.

Figure 11A:
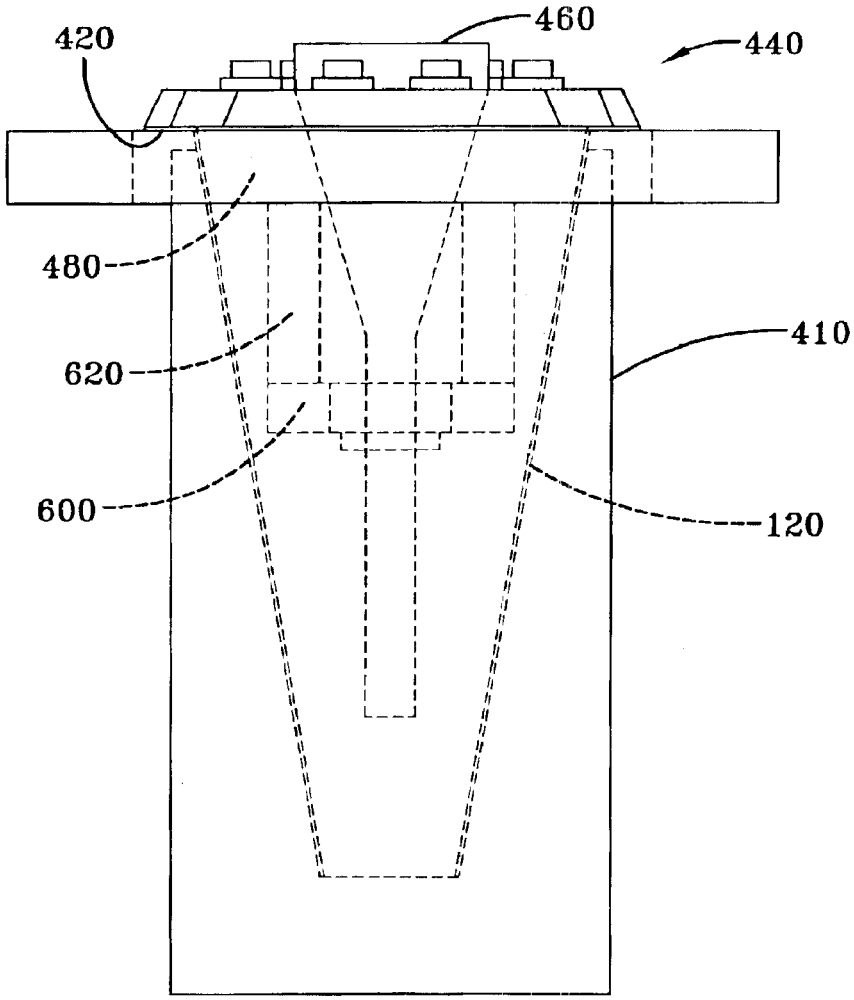
FIG. 11*a* illustrates a side view of the die of the device of FIG. 7 with the handle in the locked position.
Figure 11B:
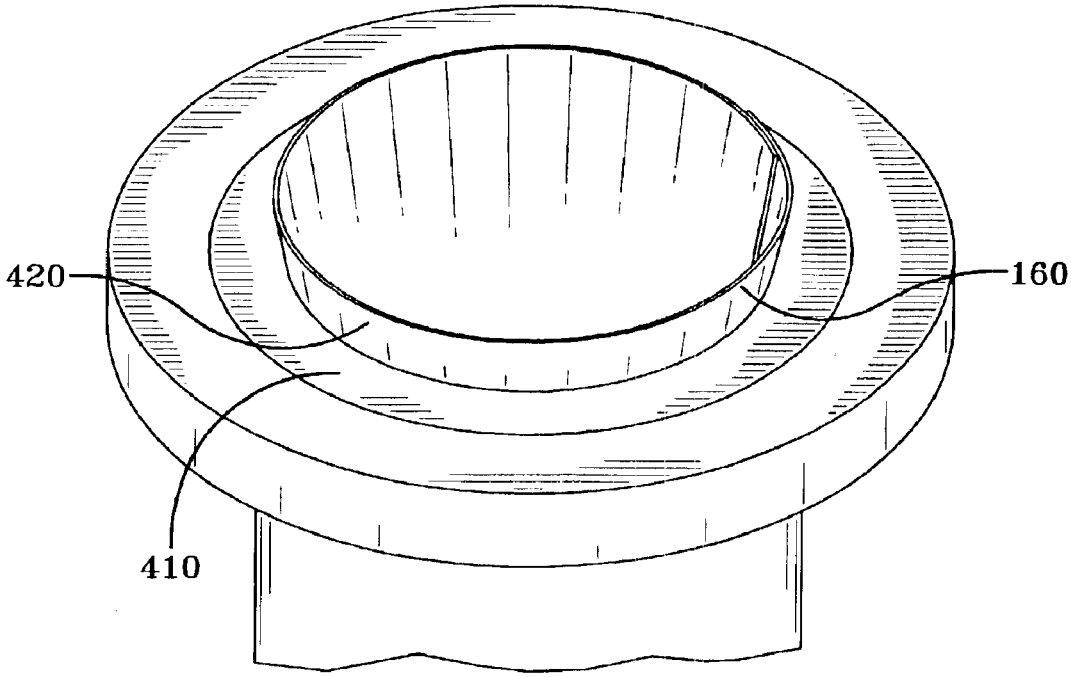
FIG. 11*b* illustrates a perspective view of the die of the device of FIG. 7 with a cone-shaped top portion inside the die.

The top portion 120 may then be inserted into a die 410 with a portion of the material 420 at the bottom end 160 of the top portion 120 protruding therefrom, as shown in FIGS. 7 and 11*b*. In an exemplary embodiment, five-eighths of an inch of the material 420 may protrude from the die 410. In another exemplary embodiment, an inch and a half or greater of the material 420 may protrude from the die 410. However, various widths of the material 420 may be made to protrude from the die 410, as required to produce various embodiments of the boot of the present invention.

Figure 11C:
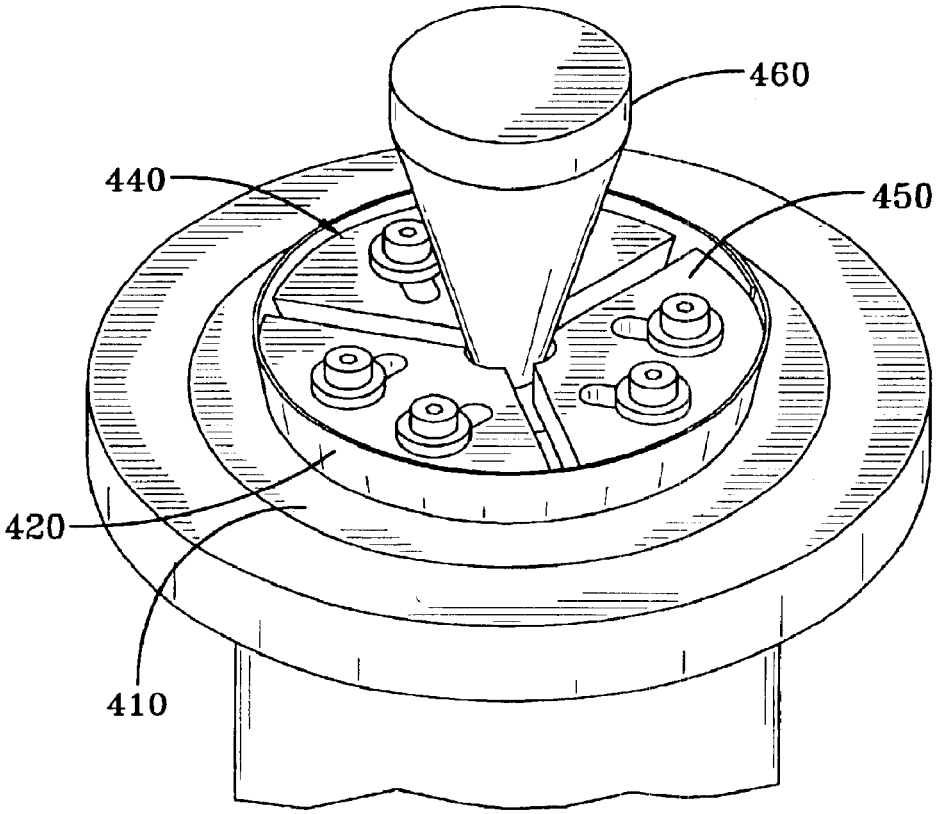
FIG. 11*c* illustrates a perspective view of the die of the device of FIG. 7 with the handle and seal forming cone inserted into the cone-shaped top portion.

Next, the seal forming cone 440 and handle 460 may be inserted into the inverted cone, i.e., top portion 120, as shown in FIG. 11*c*. The seal forming cone 440 and handle 460 initially compresses the protruding material 420 between the cap 480 (see FIG. 7) and the inner wall of the die 410. Next, the material 420 may be heated by any number of heating devices on either its outside or inside surface, or on a combination of both sides thereof.

In an exemplary embodiment, one type of heating device may be a heat gun and cone bracket assembly 500, which may be installed on top of the die 410 with the inserted seal forming cone 440 and handle 460 configuration, as shown in FIG. 7. Heat may then be funneled from a heat gun mount 520, through the channel 580 formed between the inner cone 540 and the outer cone 560, and to the entire circumference of the protruding material 420. The protruding material 420 may be heated for a sufficient amount of time to disrupt the molecules therein, and to allow the material 420 to expand in order to enable the horizontally flat circumference of the bottom edge 220 to be formed. The heating device, in this embodiment the heat gun and cone bracket assembly 500, may then be removed.

Figure 9A:
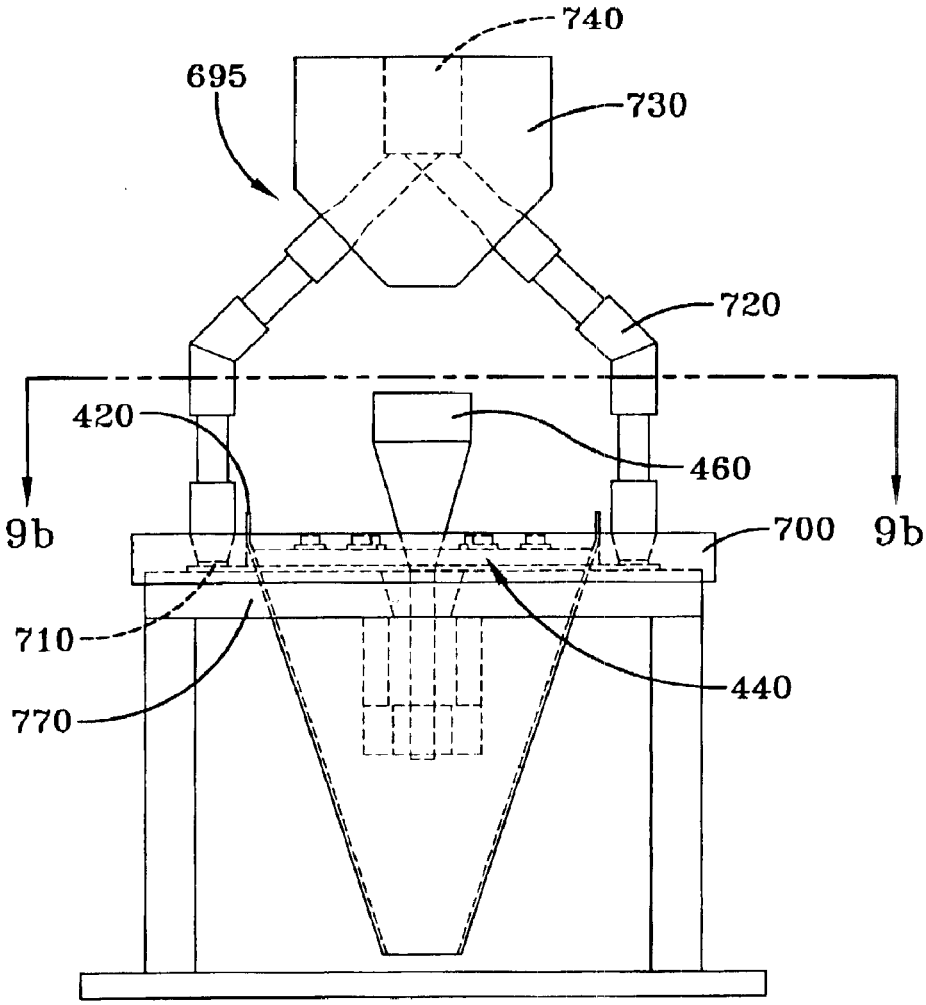
FIGS. 9*a* and 9*b* illustrate a side view and a top view, respectively, of another embodiment of a heating apparatus that may be used in forming a bottom edge on a top portion of a boot.
Figure 9B:
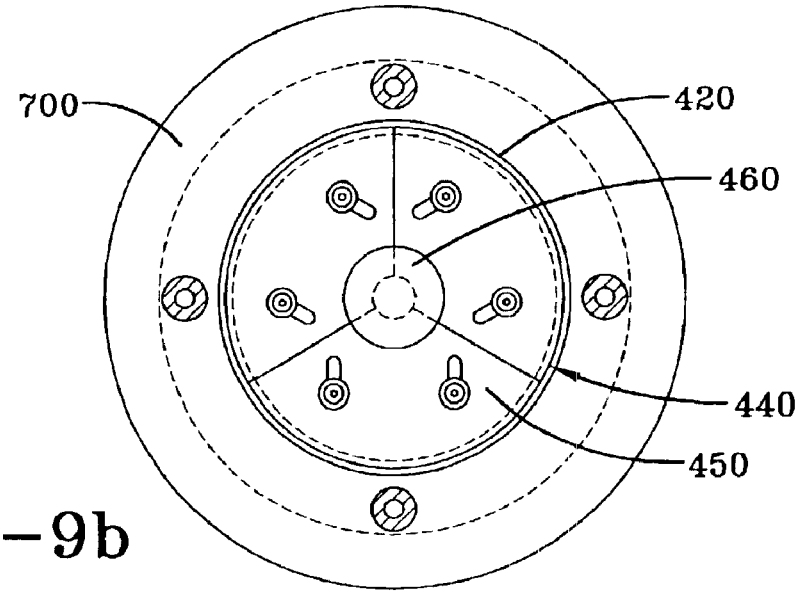
Figure 10:
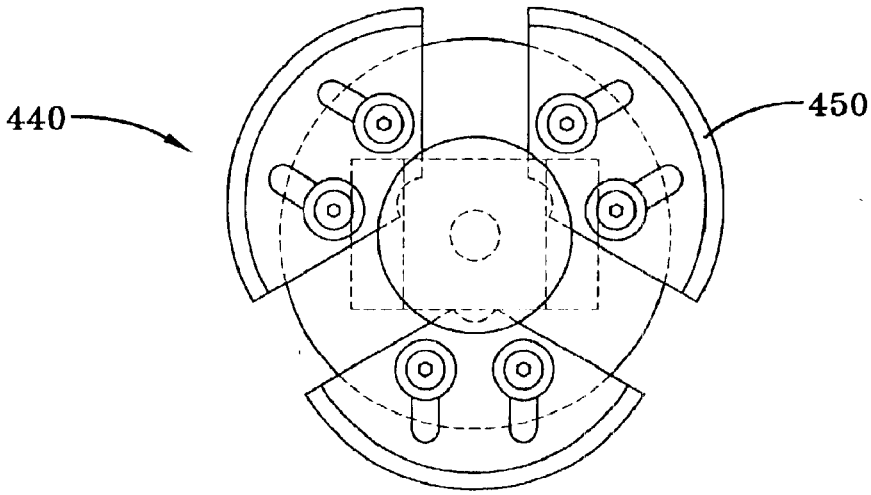
FIG. 10 illustrates expanded, members (in the shape of pie sections) of a seal forming cone of the device of FIG. 7.

In another embodiment, another type of heating device 695 that may be used is shown in FIGS. 9*a* and 9*b*. This heating device 695 may have a circular member 700, having a continuous channel 710. The circular member 700 may preferably be fitted around the protruding material 420 of the top portion 120. The circular member 700 may have a lower end of at least one, and preferably two or three, substantially hollow arms 720 attached thereto. The upper end of the arms 720 may then join together at a joining member 730, allowing the passageway within each arm to communicate with an opening 740 located therein. A hot air source (not shown), such as, but not limited to, a hot air gun, may be placed in or near the opening 740 of the joining member 730. Hot air is funneled from the hot air source, through the opening 740 of the joining member 730, and through the arms 720 to the continuous channel 710 of the circular member 700. The protruding material 420 of the top portion 120 may then be heated by the hot air for a sufficient time to disrupt the molecules thereof, and to allow the material 420 to expand in order to enable the horizontally flat circumference of the bottom edge 220 to be formed. Once the protruding material 420 is heated, the heating device 695 may be removed. FIG. 9*a* also shows that this type of heating device 695 may be used with the top portion 120 held inside a holding member 770 instead of a die 410.

Figure 11D:
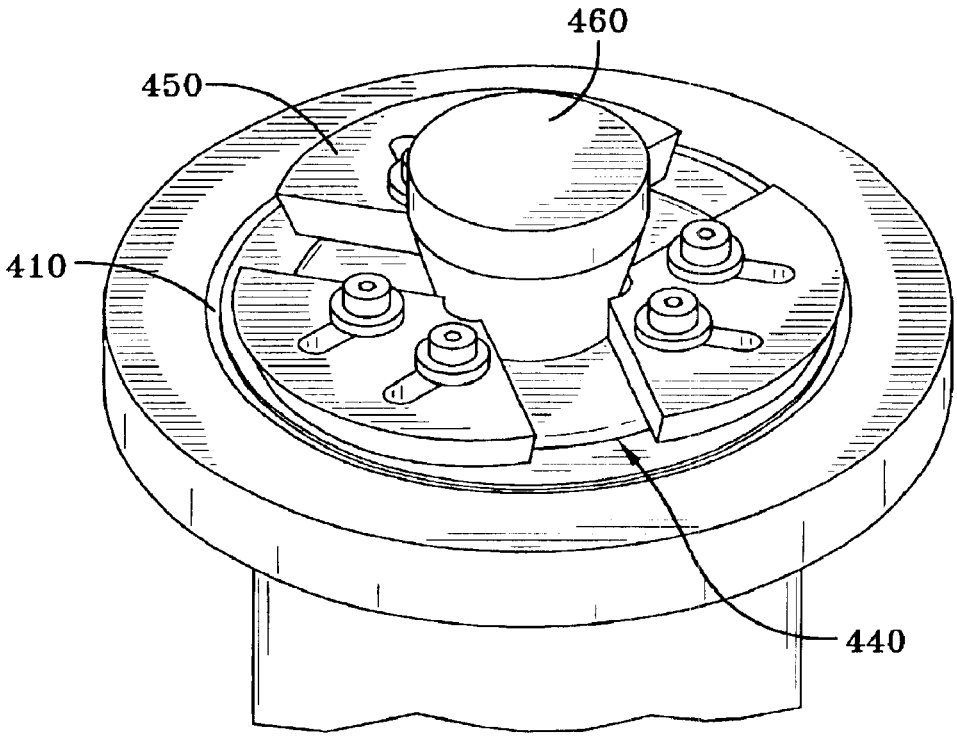
FIG. 11*d* illustrates a perspective view of the die of the device of FIG. 7 with the handle and seal forming cone in its locked position, thereby expanding the moveable sections (i.e., pies) of the seal forming cone.
Figure 11E:
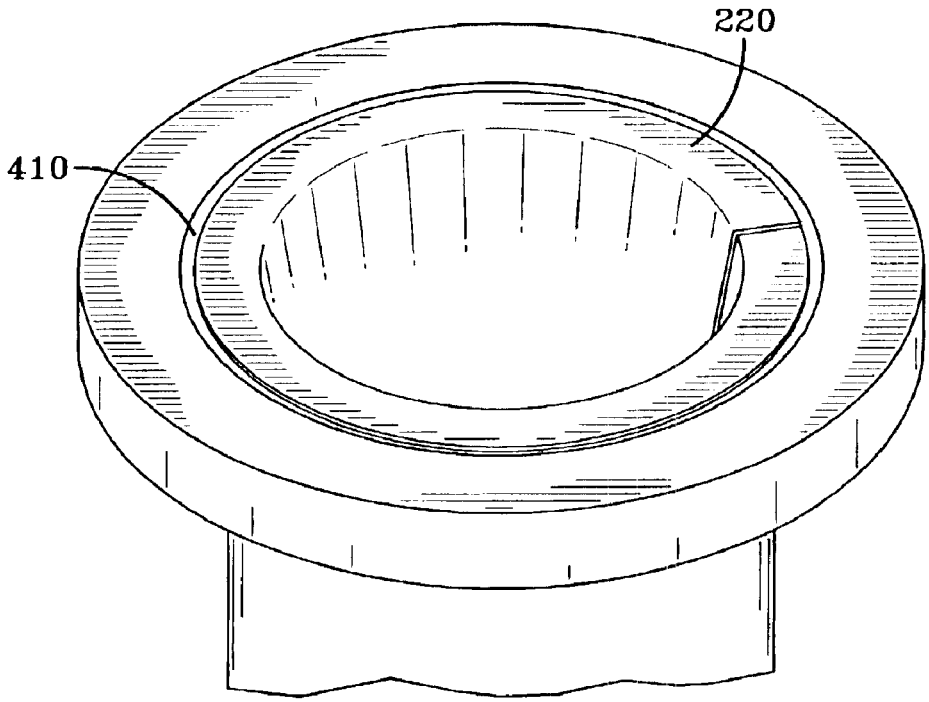
FIG. 11*e* illustrates a perspective view of the die of the device of FIG. 7 with the seal forming cone and handle removed after the bottom edge of the top portion has been formed.
Figure 12:
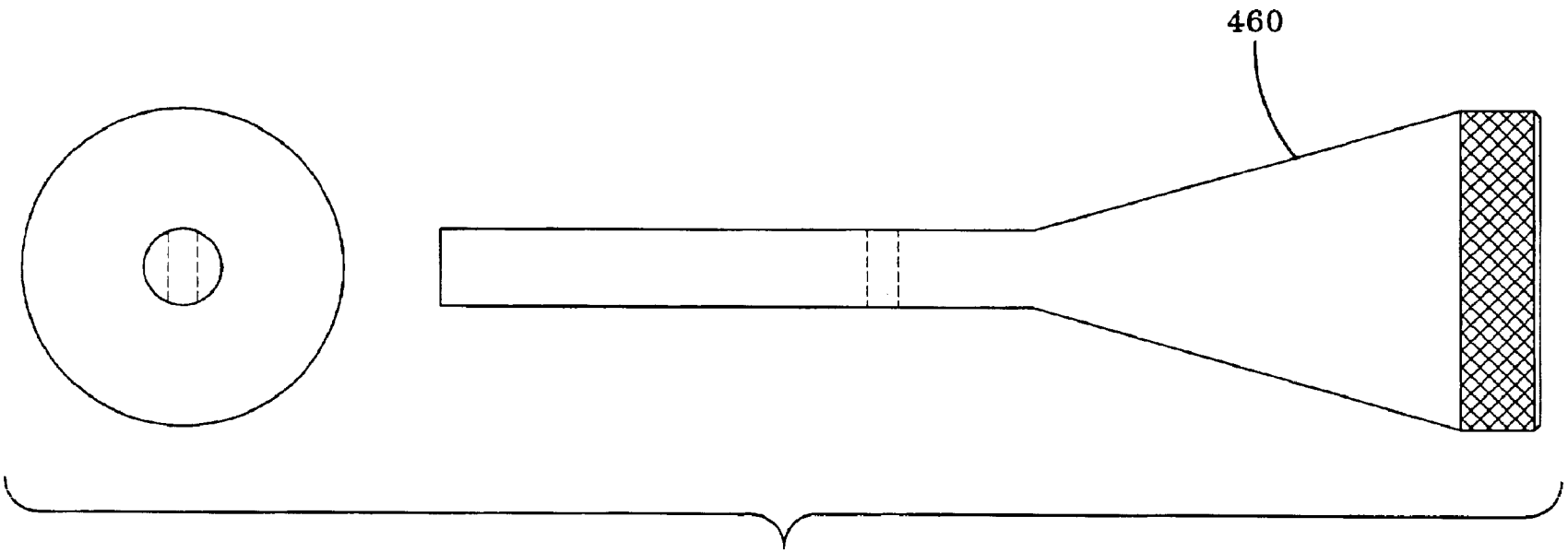
FIG. 12 illustrates a side view and bottom view of the handle of FIG. 7.
Figure 13A:
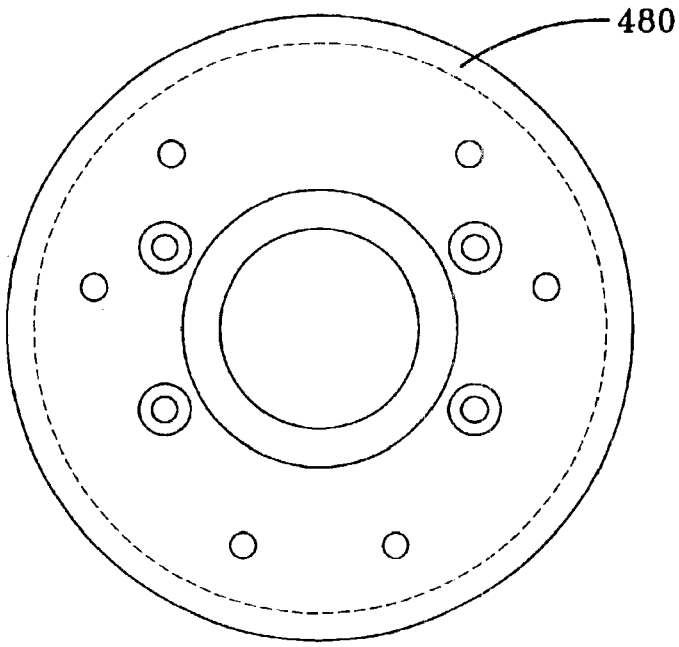
FIGS. 13*a* and 13*b* illustrate a top view and a side view of the cap of FIG. 7, respectively.
Figure 13B:
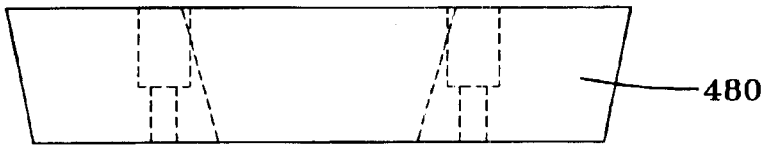
Figure 14A:
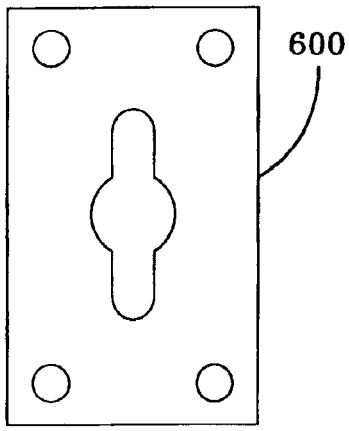
FIGS. 14*a* and 14*b* illustrate a top view and a side view of the lock plate of FIG. 7, respectively.
Figure 14B:
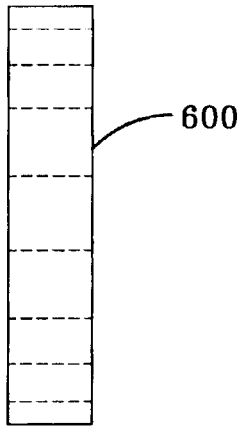
Figure 15A:
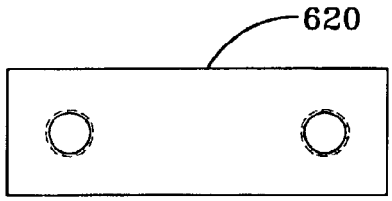
FIGS. 15*a* and 15*b* illustrate a top view and a side view of the lock plate mount of FIG. 7, respectively.
Figure 15B:
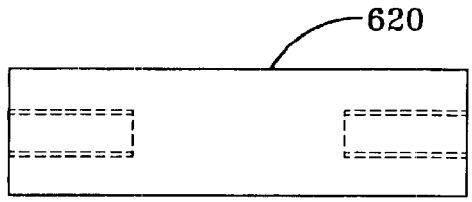
Figure 16A:
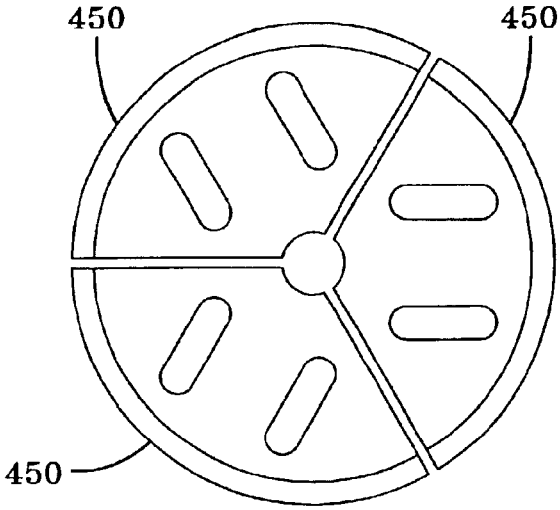
FIGS. 16*a* and 16*b* illustrate a top view and a side view of the seal forming cone of FIG. 7, respectively.
Figure 16B:
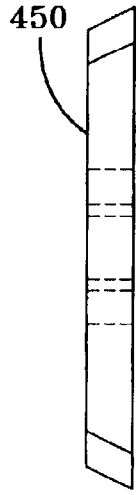
Figure 16C:
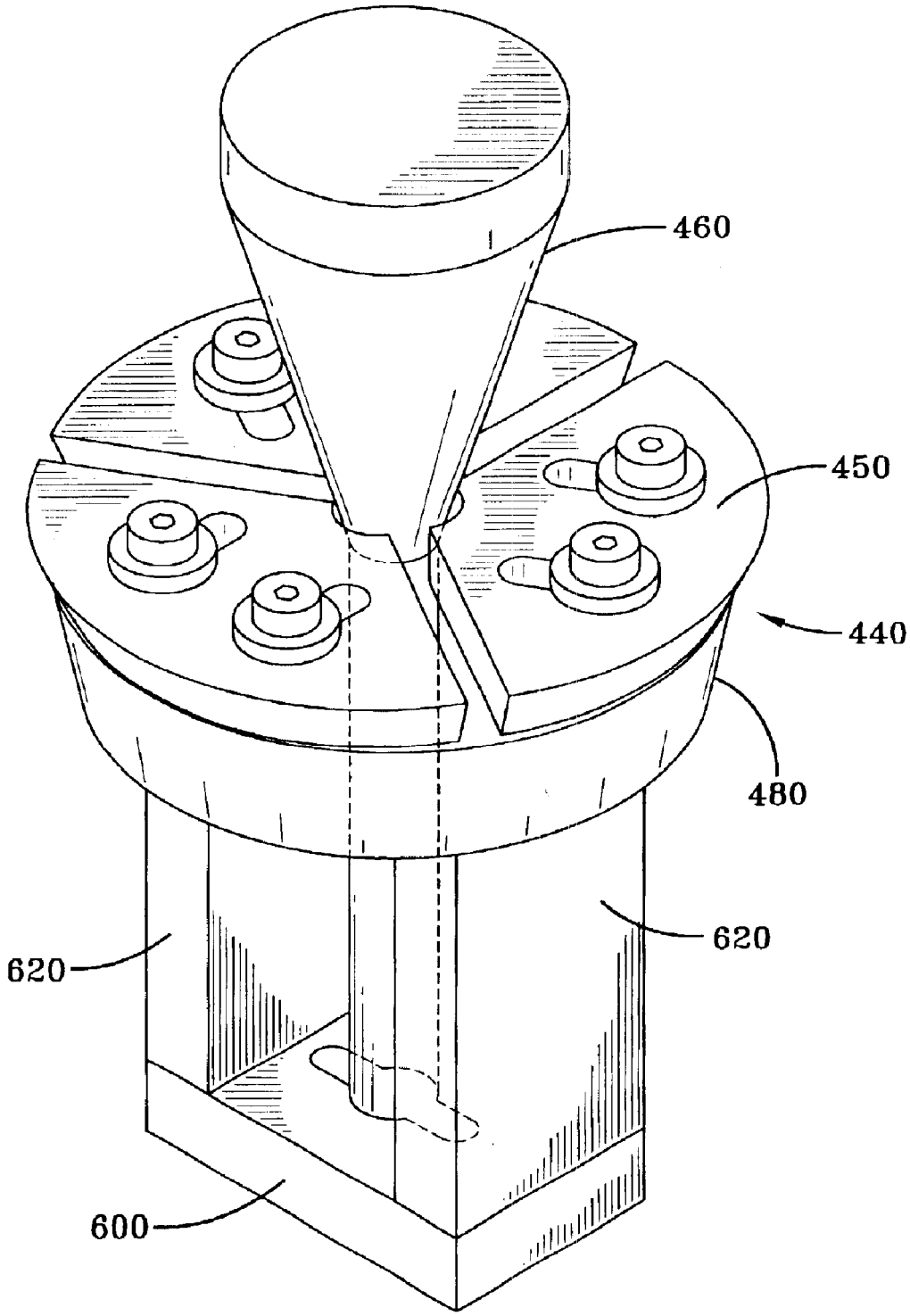
FIG. 16*c* illustrates a perspective view of the seal forming cone and handle combination of FIG. 7.
Figure 17A:
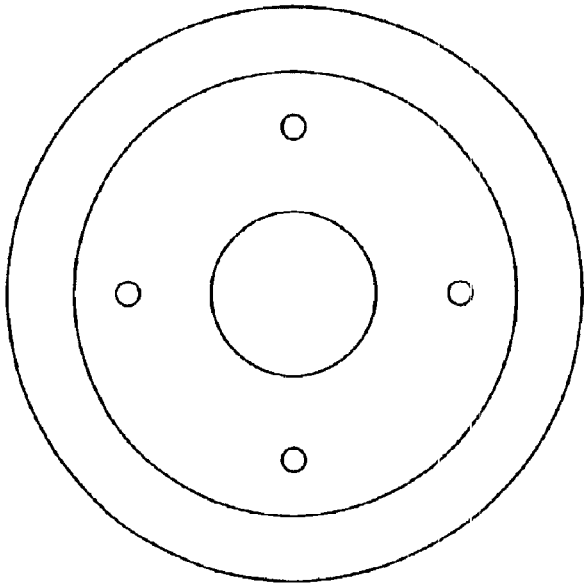
FIGS. 17*a* and 17*b* illustrate a top view and a side view of the outer cone of FIG. 7, respectively.
Figure 17B:
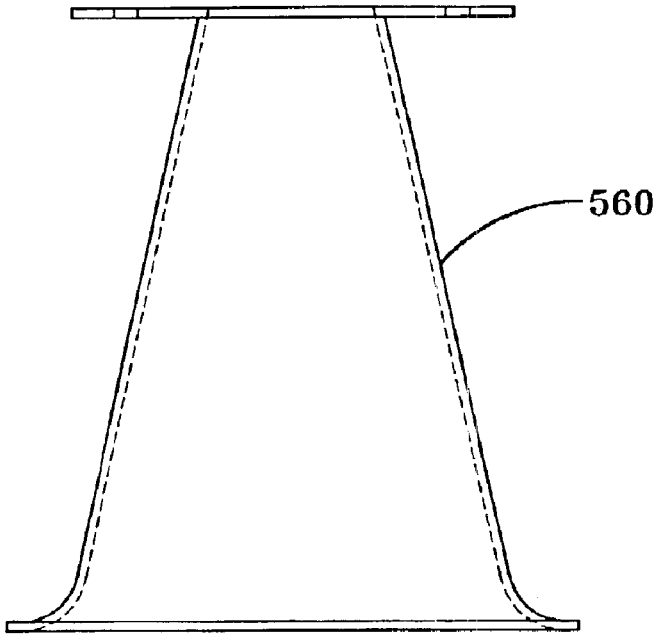
Figure 18A:
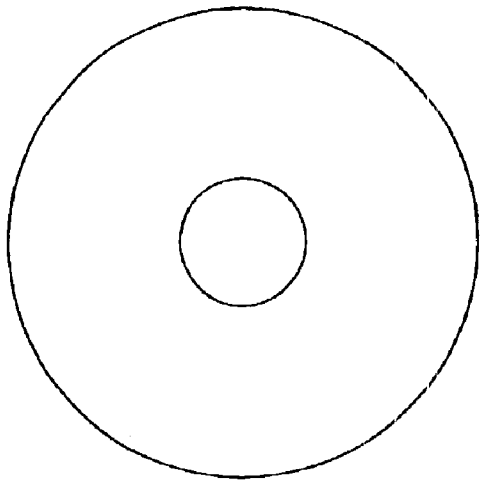
FIGS. 18*a* and 18*b* illustrate a top view and a side view of the inner cone of FIG. 7, respectively.
Figure 18B:
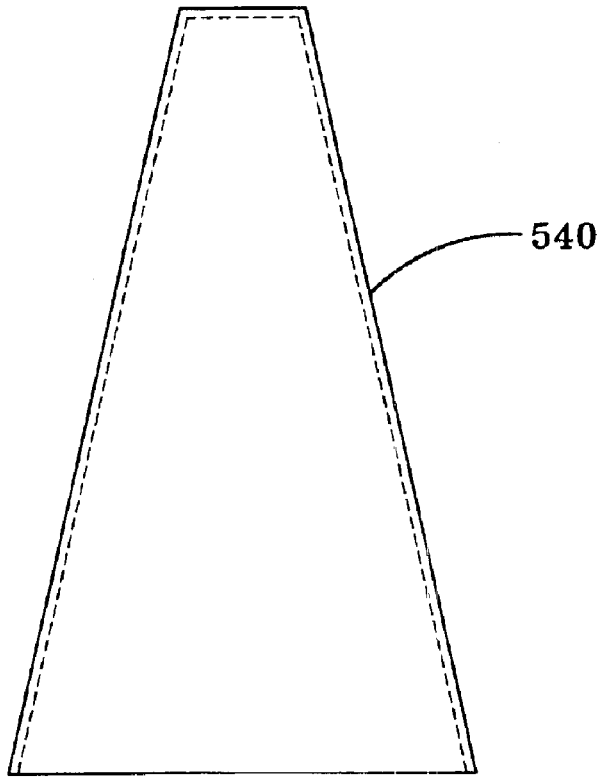
Figure 19A:
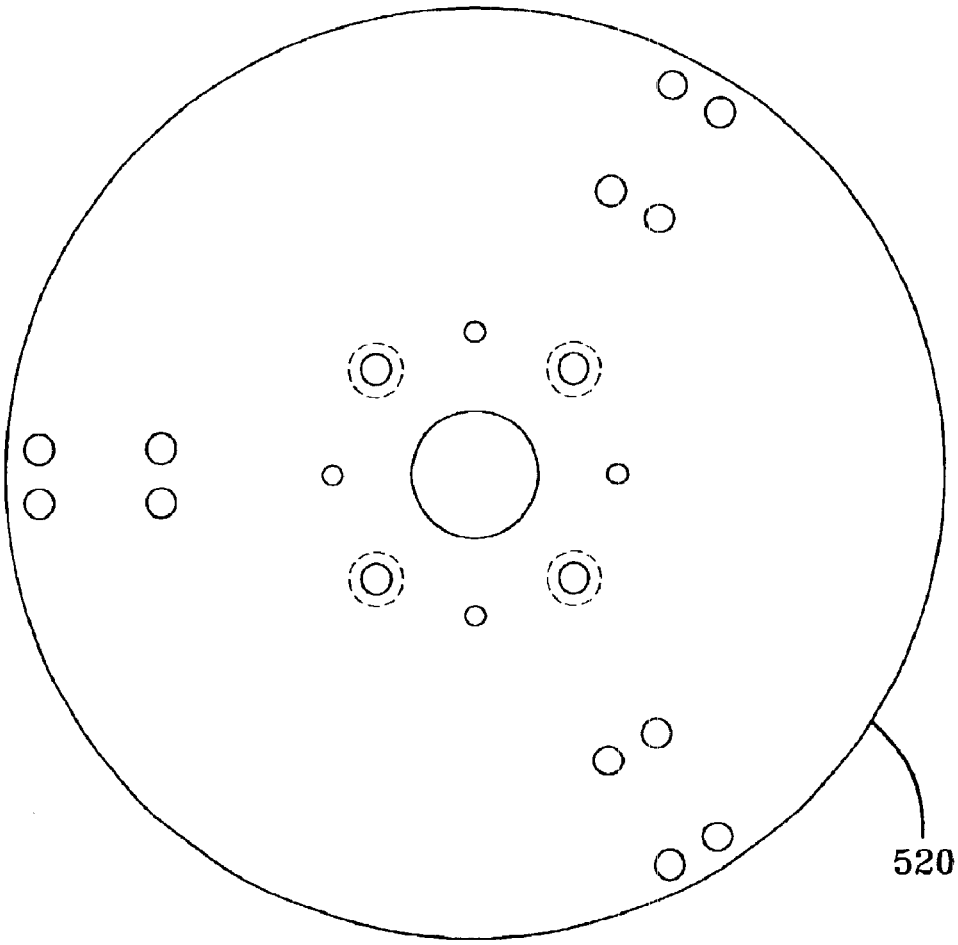
FIGS. 19*a*, 19*b*, 19*c*, 19*d* and 19*e* illustrate top views and side views of the components of the heat gun mount of FIG. 7.
Figure 19B:
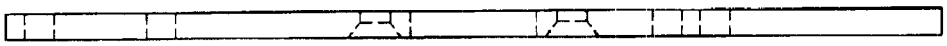
Figure 19C:
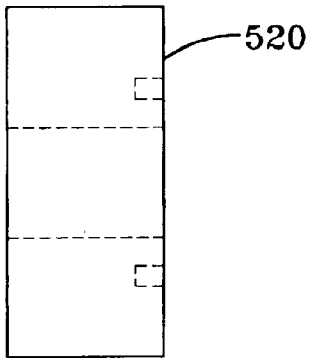
Figure 19D:
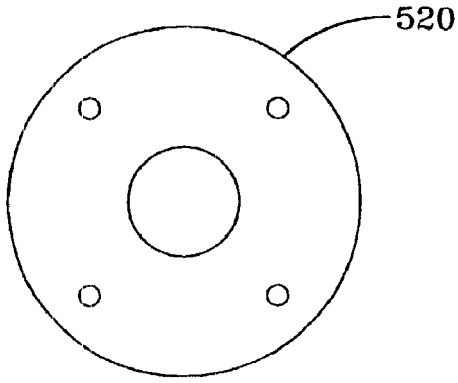
Figure 19E:
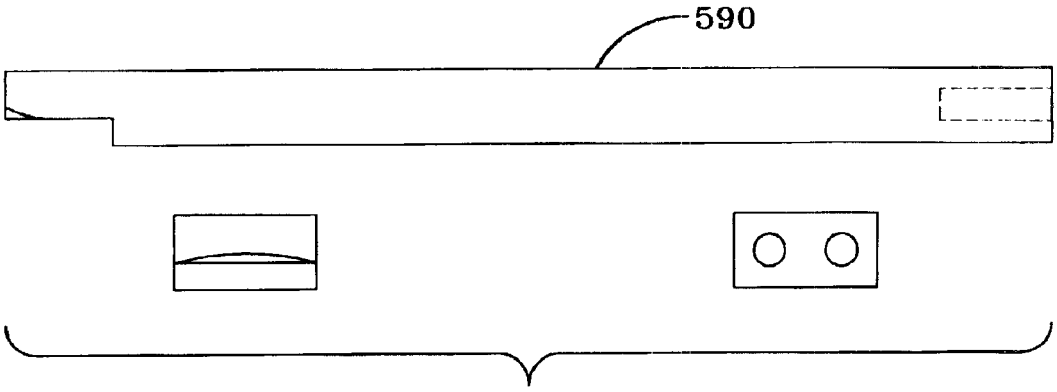
Figure 20:
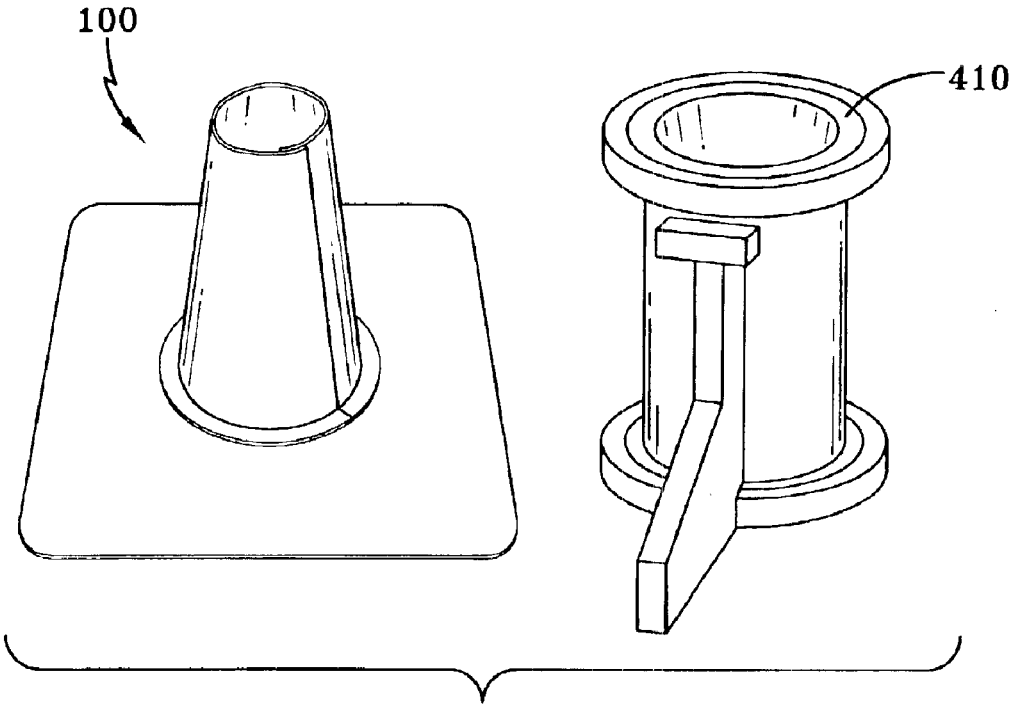
FIGS. 20, 21, 22 and 23 illustrates dies of various size that are used to manufacture embodiments of the boot of the present invention. Boot embodiments that correspond to the various dies are also depicted in the figures.
Figure 21:
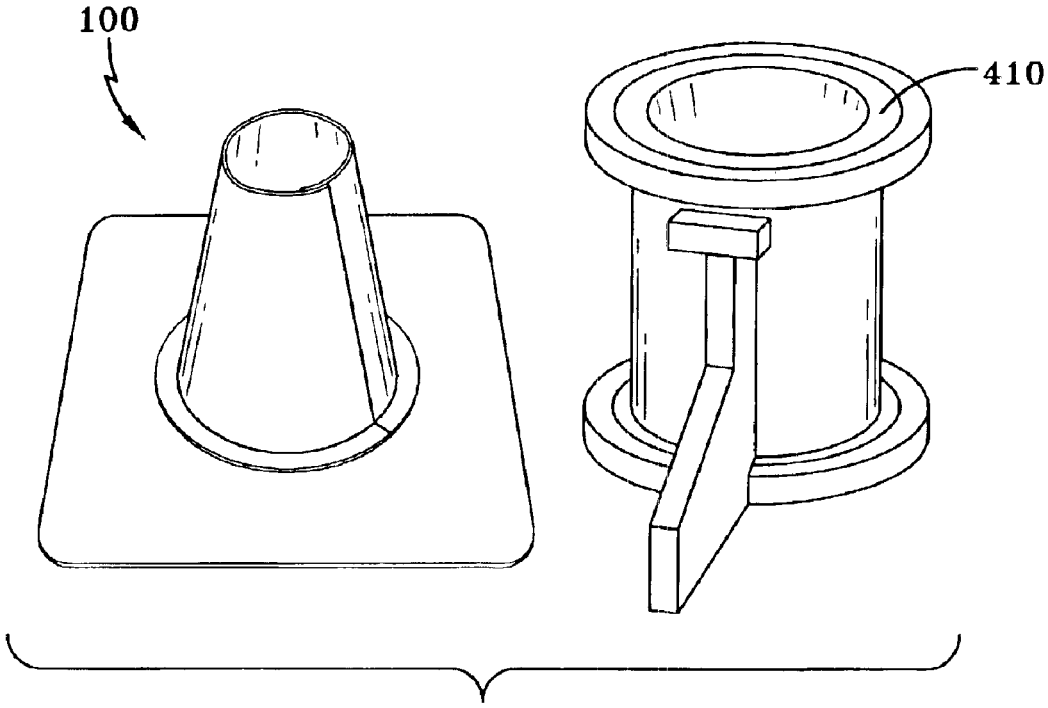
Figure 22:
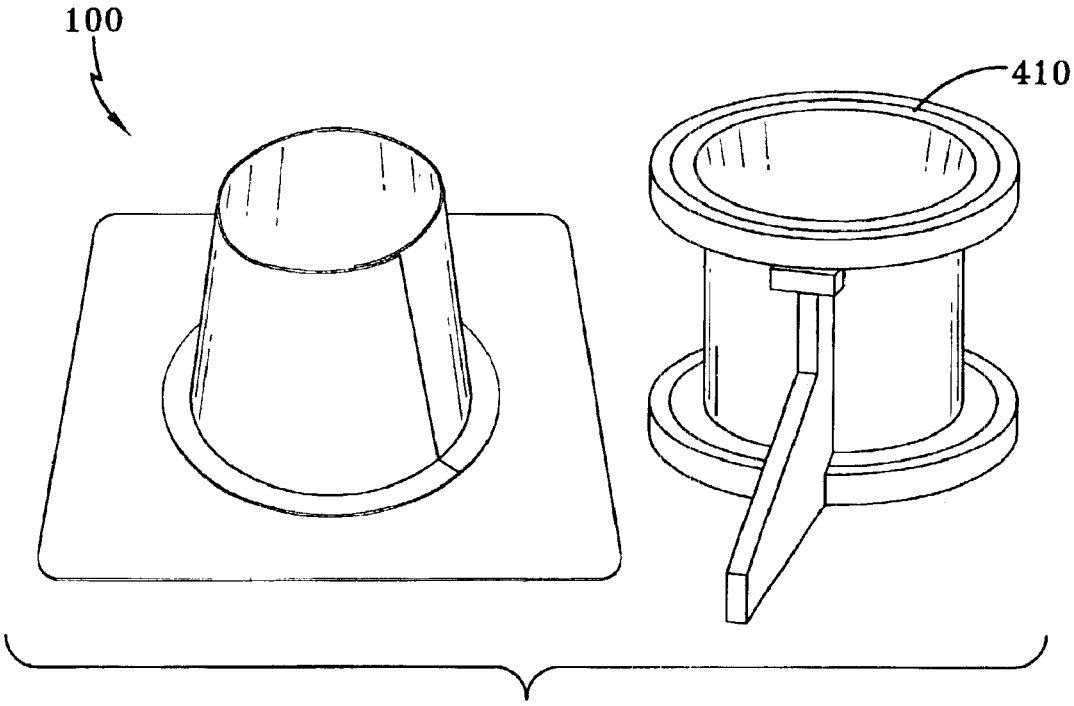
Figure 23:
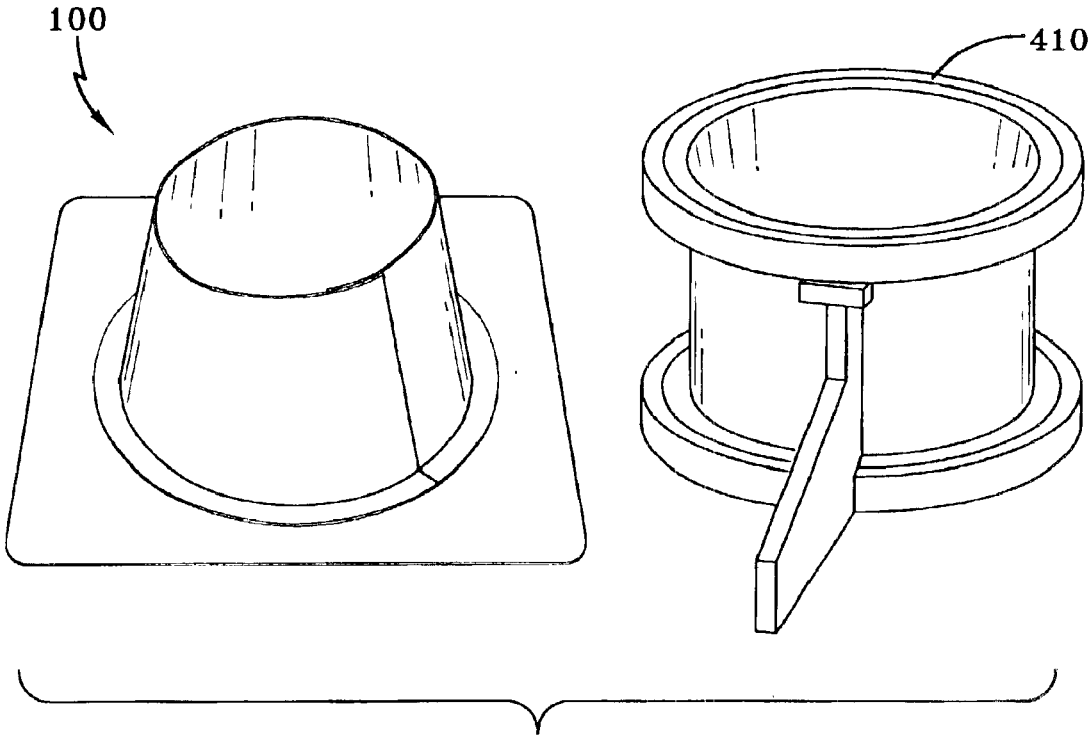
Figure 24B:
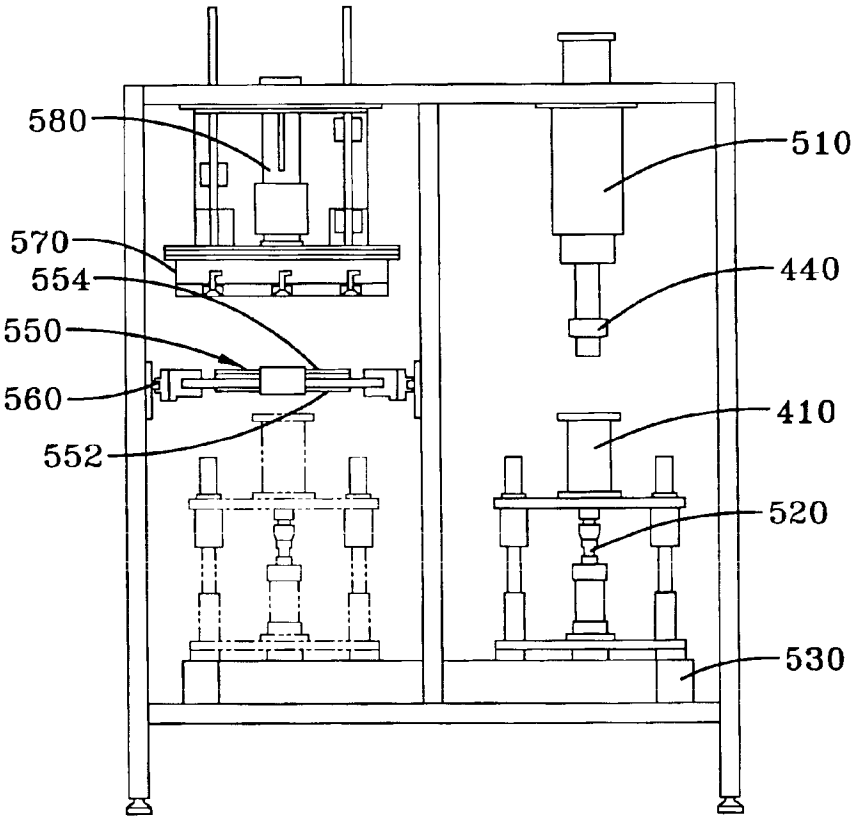
FIGS. 24A and 24B are side and front views, respectively of an example embodiment of a device for assembling the roof fitment of the present invention.
Figure 24A:
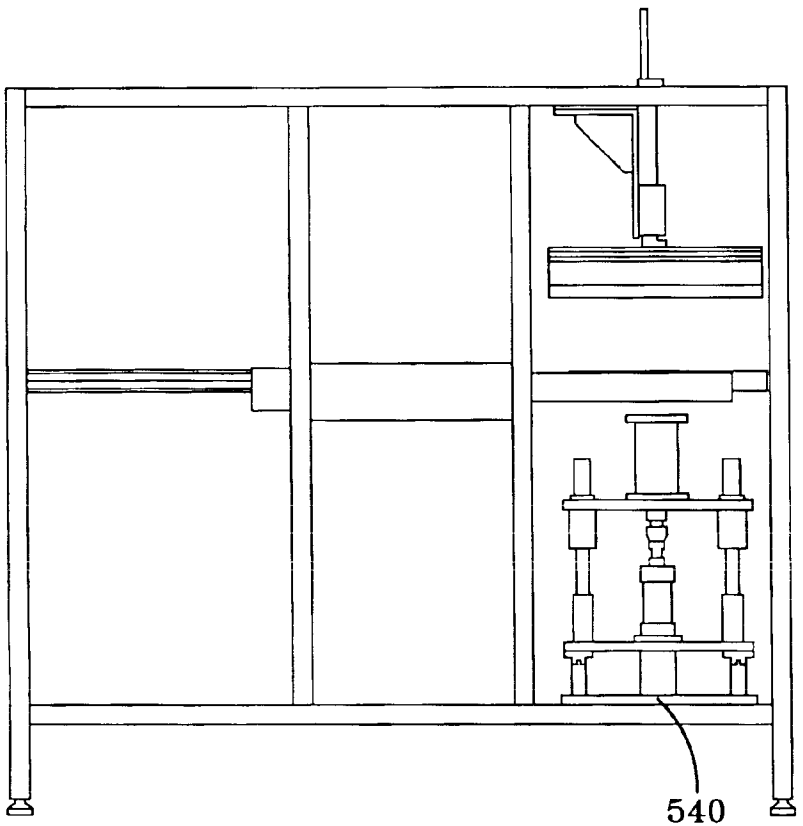

Once the protruding material 420 is heated for a sufficient amount of time, the handle 460 may be pushed downward and turned to a locking position, thereby driving the pre-shaped moveable members (e.g., pie shaped sections) 450 of the seal forming cone 440 outward, as shown in FIG. 11*d*. This action folds, but does not cut the protruding material 420 of the top portion 120. The folded protruding material 420 is also held between the bottom surface of the seal forming cone 440 and the top surface of the die 410, thereby forming a bottom edge 220 on the top portion 120 that may be a horizontally flat circumference. The flat, horizontal bottom edge 220 may then be allowed to cool naturally or with the addition of cool air to the area. The seal forming cone 440 and handle 460 combination may then be removed, leaving a top portion 120 having a bottom edge 220 that remains substantially horizontally flat, as shown in FIG. 11*e*.

FIGS. 8–11*a* and 12–19*e* illustrate particular components of the apparatus of FIG. 7 that may used to make the horizontally flat bottom edge 220 of the top portion 120. Specifically, these components comprise a die 410, seal forming cone 440, moveable sections (i.e., pies) 450, handle 460, cap 480, lock plate 600, lock plate mount 620, heat gun and cone bracket assembly 500, outer cone 560, inner cone 540, and heat gun mount 520 with heat hood supports 590.

Conical top portions 120 of various size may be made by using different die sizes. FIG. 7 illustrates different die sizes that may be used for this purpose. Also, FIGS. 20–23 illustrate various sizes of dies that may be used, as well as the finished boot 100 products that correspond to each size of die.

In an exemplary embodiment of a boot of the present invention, the horizontally flat bottom edge 220 of the top portion 120 may be placed against the edge, or perimeter, of the opening 400 in the base portion 240. Next, the base portion 240 may be sealed to the bottom edge 220 of the top portion 120. In an exemplary embodiment, the base portion 240, may be a sheet of material of a predetermined size having an opening 400 corresponding to the bottom opening 200 of the top portion 120. It is preferred that the material be of a conventional composition that lends itself to heat welding. However, other forms of sealing may be used, such as but not limited to, caulking or various types of adhesives.

In embodiments shown in FIGS. 5*a* and 5*b*, the opening 400 in the base portion 240 may be aligned with the bottom opening 200 of the top portion 120. The bottom edge 220 of the top portion 120 may then be welded to the base portion 240 such that the bottom edge 220 is substantially flat and on the same plane as the base portion 240. This weld allows the base portion 240 to lay substantially flat during the welding process, obviating the need to deform the edge 405 of the base opening 400 to accomplish the weld.

In an alternative embodiment (not shown), the edge 405 of the base opening 400 may be folded upward to make a lapped engagement with the vertical portion of the top portion 120. In such case, a lap weld may be made both along the intersection of the substantially flat base portion 240 and the bottom edge 220 of the top portion 120, as well as along the intersection of the vertical top portion 120 and upwardly bent edge 405 of the base opening 400—thereby providing a strong weld.

In an exemplary embodiment, the top portion 120 may be substantially vertical with respect to the base portion 240 when the base portion 240 is in the flat horizontal position (e.g. on the roof substrate).

In yet another exemplary embodiment, the top portion 120, having a bottom edge 220 of sufficient width, may be used without a base portion 240. In this embodiment, the top portion 120 may have a bottom edge 220 of preferably one and one half inches or greater in width. However, various widths of the bottom edge 220 may be used with this embodiment. This bottom edge 220 acts as a base and may be sealed directly to the roof membrane to provide a water-tight seal around the protrusion.

Figure 6:
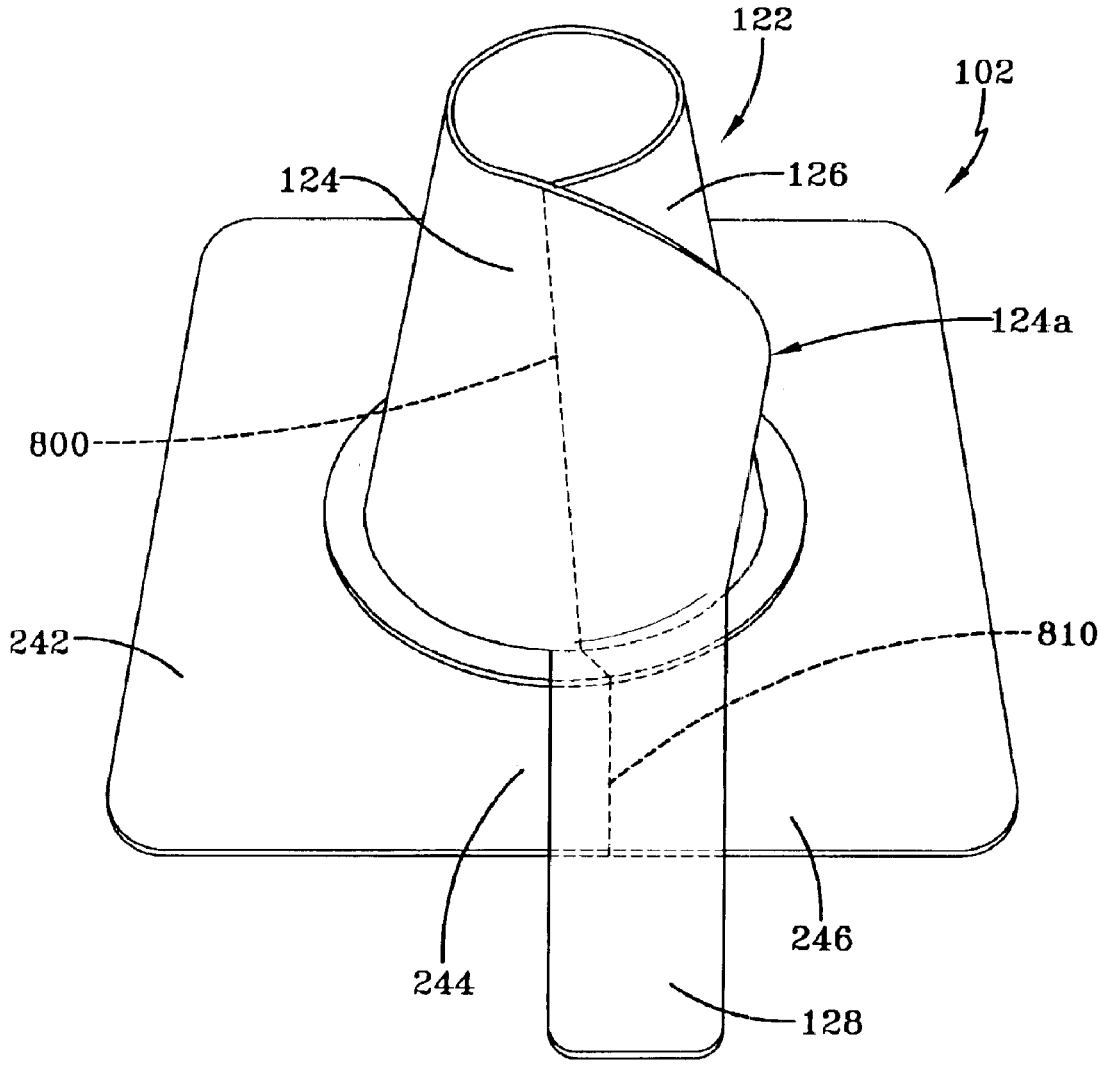
FIG. 6 illustrates a perspective view of an open stack embodiment of the boot of the present invention.

In another embodiment of the present invention, illustrated in FIG. 6, the boot (or flashing) 102 may be an open design. In other words, there may be a break 800 in the top (or vertical) portion 122 of the boot 102. The base portion 242 of the boot 102 may also have a break 810 (break 810 meets the break 800 in the top portion 122) so that the boot 102 may be opened to accept an existing vertical protrusion on the roof.

As illustrated in FIG. 6, the break 810 in the base portion 242 separates a first portion 244 of the base portion 242 from a second portion 246 of the base portion 242. The break 800 in the top portion 122 separates a first portion 124 of the top portion 122 from a second portion 126 of the top portion 122.

In an exemplary embodiment of the open stack boot 102, the break 810 in the base portion 242 is aligned with the break 800 in the top portion 122. The breaks 800, 810 in the boot 102 allows the boot 102 to be opened to accept a protrusion on the roof to be covered. After wrapping the protrusion, the top and base portions 122, 242 may be welded along the breaks 800, 810 to complete the seal.

The boot 102 of the open stack embodiment may also have a base flap 128 which may be used to seal together the first portion 244 and the second portion 246 of the base portion 242. In one embodiment, the base flap 128 is part of an overlap portion 124*a* that is used to bond or weld the first portion 124 and the second portion 126 of the top portion 122 together. In an alternative embodiment, the base flap 128 may be connected to another portion of the boot 102 (e.g., base or non-overlapping portion). It is appreciated that there may be different size stacks for the various size pipes.

The boot 100 of the present invention may be installed by placing the bottom opening 200 of the top portion 120 and the base opening 400 of the base portion 240 over the protrusion (e.g. pipe) to be covered. The top opening 180 of the top portion 120 should not be higher than the top of the protrusion. The base portion 240 may be flat over the roof. Next, the top portion of the side edge 360 (e.g. the flap portion 270) of the vertical top portion 120 may be pulled around the protrusion so that the top opening 180 is adjusted to fit the diameter of the protrusion. The top opening 180 of the top portion 120 may then be sealed around the protrusion. In an exemplary embodiment, the top portion of the side edge (e.g. the flap portion 270) may be heat sealed or welded to the corresponding top portion of the other side edge 340, on site. The base portion 240 may then be heat sealed or welded to the underlying roofing membrane to provide a water-tight seal around the protrusion.

The boot 102 of the present invention which has an open design (open stack) may be installed by opening the boot 102 along the breaks 800, 810. The first portions 244, 124 of the base portion 242 and the top portion 122 may be pulled around the protrusion and sealed to the second portions 246, 126 of the base portion 242 and top portion 122, respectively. Specifically, the first portion 124 of the top portion 122 may be sealed to the second portion 126 of the top portion 122, while the first portion 244 of the base portion 242 may be sealed to the second portion 246 of the base portion 242 after it is pulled around the protrusion. Then the boot 102 may be sealed to the roof membrane as described above.

In an alternate embodiment, a top portion 120, having a bottom edge 220 of sufficient width, may be used without a base portion 240. In this embodiment, the top portion 120 may be installed by placing the bottom opening 200 of the top portion 120 over the protrusion (e.g. pipe) to be covered. The top opening 180 of the top portion 120 should not be higher than the top of the protrusion. Next, the top portion of the side edge 360 (e.g. the flap portion 270) of the vertical top portion 120 may be pulled around the protrusion so that the top opening 180 may be adjusted to fit the diameter of the protrusion. The top opening 180 of the top portion 120 may then be sealed around the protrusion. The bottom edge 220 of the top portion 120, may act as a base and then be heat sealed or welded directly to the underlying roofing membrane to provide a water-tight seal around the protrusion. In this exemplary embodiment, the bottom edge 220 of the top portion 120 may be about one and one half inches or greater in width. However, various widths of this bottom edge 220 may accomplish a seal with the underlying roof membrane without a base portion 240.

FIGS. 24A–27 illustrate an example embodiment of the device for assembling the roof fitment of the present invention. The device includes a seal forming cone 440 positioned by a vertically movable arm 510 over the top of a die 410 appropriately sized to accommodate the top portion 120 of a boot 100 to be formed.

The top portion 120 is placed in the die 410 so that the bottom opening 200 is facing up toward the seal forming cone 440. The arm 510 moves down, allowing the seal forming cone 440 to enter the bottom opening 200 and cold form the bottom edge 220 of the top portion 120.

One example embodiment of the present invention includes a vacuum source connected to the complementary edge of the die 410 where the cold formed bottom edge 220 is formed by the insertion of the seal forming cone 440 and the movable sections (pies) 450 to form the flattened bottom edge 220 of the top portion 120. In this example embodiment, the vacuum along the complementary edge assists the positioning of the bottom edge 220 in preparation for sealing at least a portion of the edge 220 to at least a portion of the base portion 240 in the vicinity of the opening 400 in the base.

The seal forming cone 440 is retracted by movement of the movable arm 510 from the top portion 120 now having the cold formed bottom edge 220. The die 410 then moves to a second position on its movable arm 520 on a sliding assembly 530 moving along a guide rail 540 on the machine frame.

The die 410 is then positioned under a heat conductive plate 550 mounted on a support rail 560 to the machine frame. Next, the die 410 holding the top portion 120 having the bottom edge 220 is raised by the movable arm 520 up to a side 552 of the heat conductive plate 550. On the opposite side 554 of the heat conductive plate 550, a vacuum plate 570 holding a base portion 240 is lowered by a movable arm 580 to its respective side 554 of the heat conductive plate 550. The top portion 120 and the base portion 240 are then heated for a time sufficient to allow the welding of at least a portion of the top portion 120 to at least a portion of the base portion 240.

After a sufficient period of heating, the arms 520 and 580 retract slightly away from the heat conductive plate 550 to allow the heat conductive plate to move away on the support rails 560 from between the top potion 120 in the die 410 and the base portion 240 on the vacuum plate 570.

The arms 520 and 580 then extend again to place at least a portion of the top portion 120 and the base portion 240 together to allow the heated portions to seal together to form the finished boot 100.

After sufficient time to allow for the bonding of the top portion 120 to the base portion 240, the arms 520 and 580 retract sufficiently to allow removal of the finished boot 100 from the device of the present invention. The die 410 can then be repositioned for the initiation of the assembly process for the next boot 100 to be made.

Figure 25A:
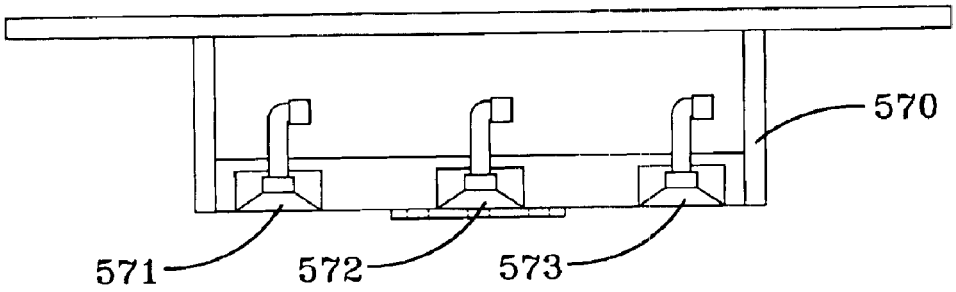
FIGS. 25A, 25B, and 25C are views of example embodiments of a vacuum plate of an upper fixture of a device for assembling the roof fitment of the present invention.
Figure 25B:
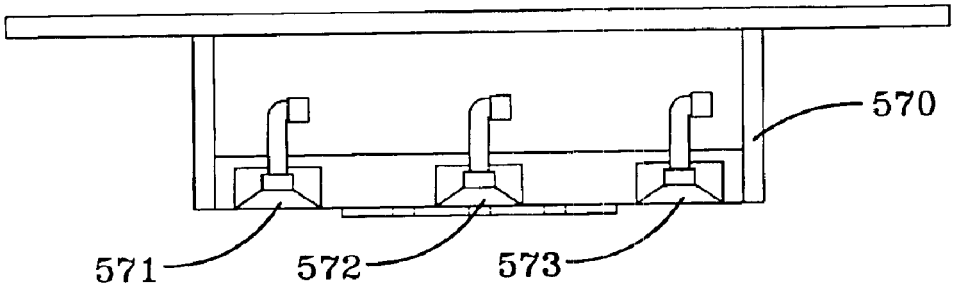
Figure 25C:
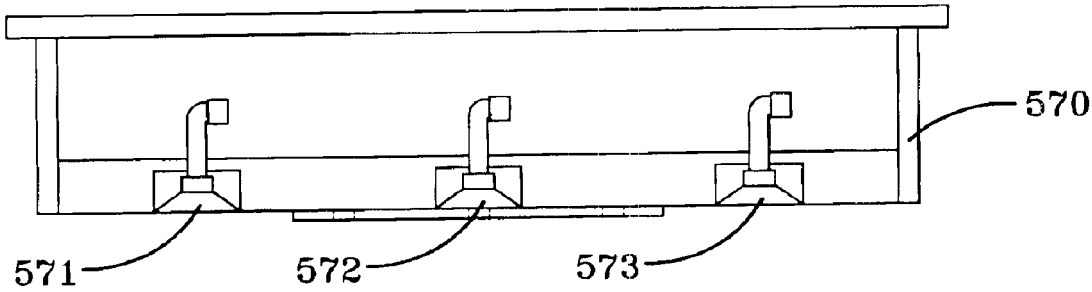

As shown in FIGS. 25A, 25B, and 25C, the vacuum plate 570 may have different sizes, different spatial arrangements, and/or have multiple vacuum points such as are shown at 571, 572, and 573 to accommodate different sized base portions 240.

In addition, the seal forming cone 440 can accommodate different sized lock plates 600, lock plate mounts 620, caps 480, and movable sections 450 to allow different sized and shaped top portions 120 to be formed by the seal forming cone's 440 insertion into a die 410.

The present invention provides for different sequences of movement by the movable arms 510, 520, and 580. In some embodiments, an arm or arms may not be required to move in order to form the example embodiment boots 100 of the present invention. For example, the seal forming cone 440 may remain stationary as the die 410 is raised by arm 520 to insert the cone 440 in the die 410. Additionally, the die 410 holding the formed top portion 120 having the bottom edge 220 may rise on arm 520 to contact the bottom opening 200 in the base portion 240 held by a stationary vacuum plate 570. Then by application of an appropriate amount of force between the vacuum plate 570 and the die 410, the top portion 120 can be sealed to at least a portion of the base portion 240.

Another embodiment of the present invention allows for the arms 510, 520, 580 to have positioning capability sufficient to allow adjustment to insure the proper alignment of an opening 400 in a base portion 240 with the bottom opening 200 in the top portion 120.

Figure 26:
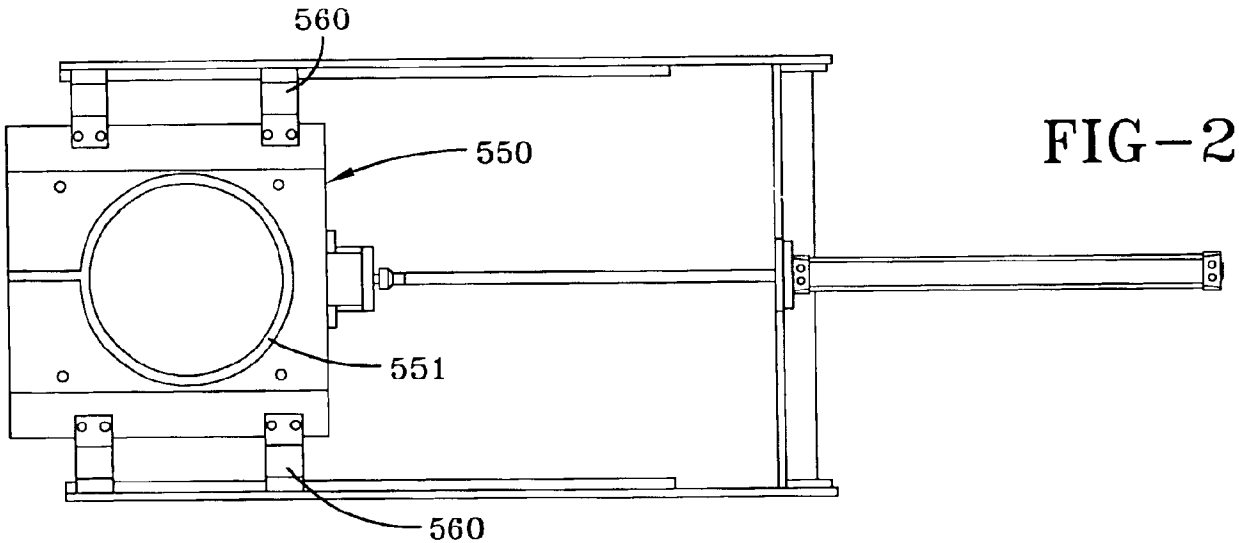
FIG. 26 is a top view of an example embodiment of a heat platen assembly of a device for assembling the roof fitment of the present invention and FIGS. 26A, 26B, and 26C are top views of an example embodiment of the heat conductive plate having different sized heating elements.
Figure 26C:
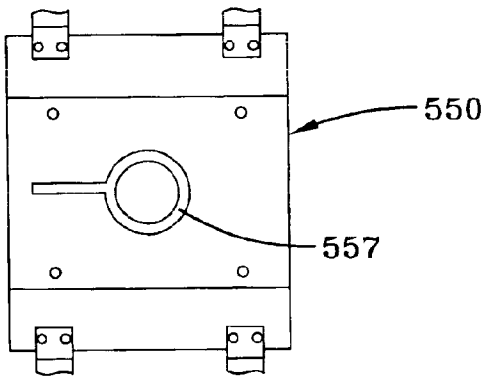
Figure 26B:
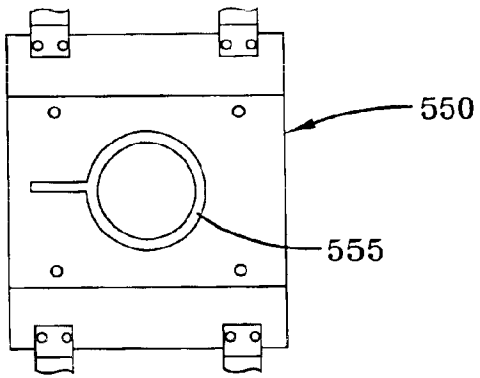
Figure 26A:
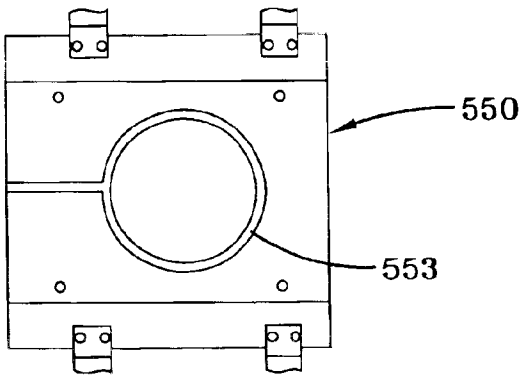
Figure 27:
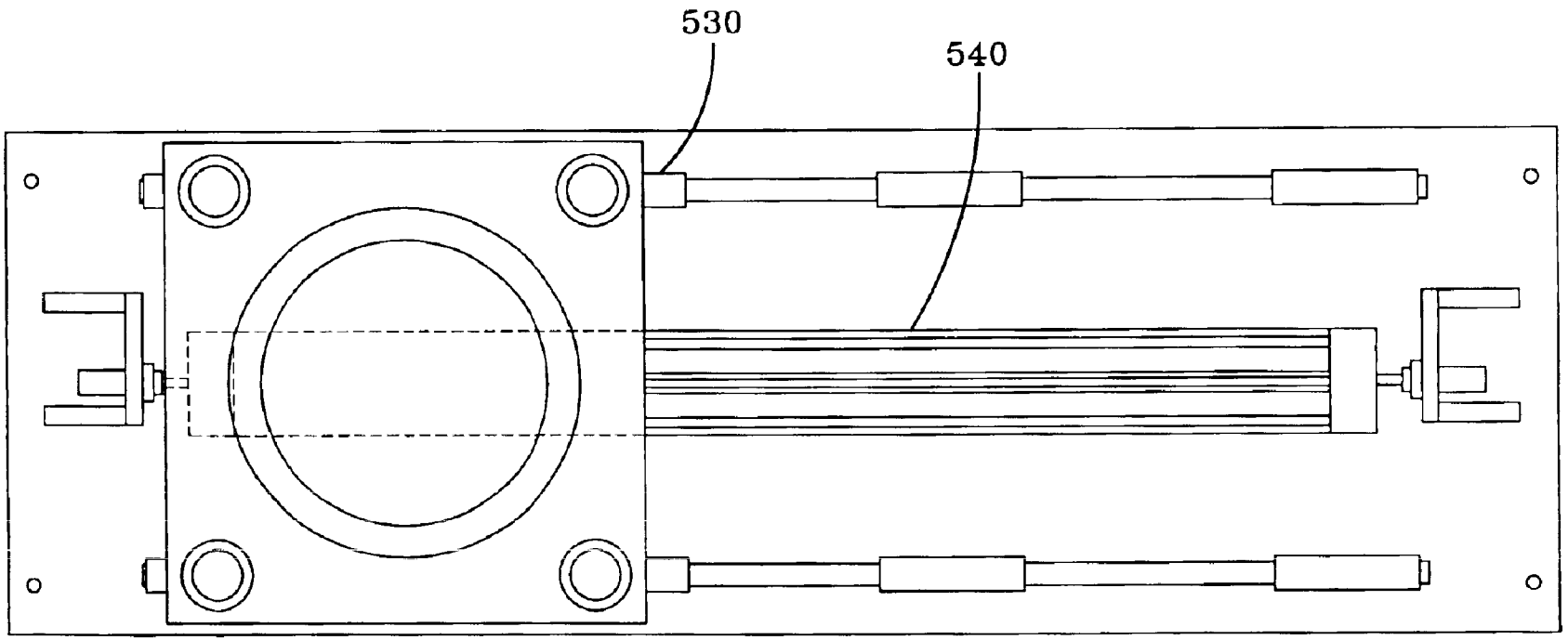
FIG. 27 is a top view of an example embodiment of a transfer assembly of a device for assembling the roof fitment of the present invention.

As shown in FIG. 26, another embodiment of the present invention allows for the heat conductive plate 550 to have the capability to hold appropriately sized heating elements such as are shown on FIGS. 26, 26A, 26B, and 26C at 551, 553, 555, and 557, respectively, in order to match the desired portion and or size of a top portion 120 and a base portion 240 to be welded together to make a finished boot 100.

The boots 100, 102 of the present invention allow for easier and more costeffective manufacture and installation and also allow for the water-tight sealing of pipes of various diameters.

The boots 100, 102 of the present invention may be made of various materials including, but not limited to, thermoplastic materials such as polyvinyl chloride (PVC), and thermoplastic polyolefin (TPO). Additionally, various methods of sealing the material may be used. These methods included, but are not limited to welding, hot air bonding, caulking or the use of various types of adhesives.

The present invention is adaptable to be made from any flexible material, particularly those materials known by those skilled in the art as flexible materials that may be used for a roofing membrane. In addition to PVC and TPO material, the material may be comprised of a rubber. In addition, the materials include bondable materials. The types of bonds suitable for use with such material include heat bonds, adhesive or glue bonds, and solvent bonds.

PVC, TPO and other suitable material may be used when the assembly of the component portions of the present invention fitments 100 and 102 uses a mode for attachment other than hot air bonding and dielectric welding, such as caulking or adhesives. In addition to dielectric welding and hot air bonding, other methods of attachment include solvent fusion, adhesive bonds, heat welding, melted welding, vibration welding, ultrasonic welding, and heat staking.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A device for assembling a roof fitment, said device in a machine frame, said device comprising:

an upper fixture assembly, comprising:

a seal forming cone mounted on a first movable arm to said machine frame; and a vacuum plate mounted on a second movable arm to said machine frame;

a heat platen assembly; and a transfer assembly.

2. The device of claim 1, wherein:

said heat platen assembly comprises:

a heat conductive plate movably mounted to a support rail on said machine frame; and a heating element in thermal contact with said heat conductive plate.

3. The device of claim 1, wherein:

said transfer assembly comprises:

a die mounted on a third movable arm; and a sliding assembly mounted to said third movable arm, said sliding assembly being movable along a guide rail on said machine frame.

4. A device for assembling a roof fitment, said device in a machine frame, said device comprising:

a seal-forming cone mounted on a first movable arm to said machine frame, a vacuum plate, adapted to hold a base portion of a boot for the roof fitment, mounted on a second movable arm to said machine frame; and a die, adapted to hold a top portion of the boot, mounted on a third movable arm, wherein said seal forming cone is inserted into said die to cold form a bottom edge on said top portion;

wherein said die moves to a position aligning a bottom opening on said top portion and a base opening on said base portion; and wherein said second movable arm and said third movable arm extend to place said base portion and said top portion, respectively, into contact with a holding pressure sufficient to allow bonding together of at least a portion of said base portion and at least a portion of said top portion.

5. The device of claim 4 additionally comprising:

a heat platen mounted to said machine frame, said heat platen providing sufficient heat to bond at least a portion of said base portion to at least a portion of said top portion.

6. The device of claim 4 additionally comprising:

a heating stylus, said heating stylus providing a source of hot air for welding together at least a portion of said top portion and at least a portion of said base portion.

7. The device of claim 6 wherein said heating stylus rotates around at least a portion of a perimeter around an intersection of a portion of said top portion and a portion of said base portion to be sealed together.

8. The device of claim 6 wherein at least a portion of a perimeter around an intersection of a portion of said top portion and a portion of said base portion to be sealed together rotate past said heating stylus.

9. The device of claim 4 wherein said die is for an open design boot.

10. The device of claim 4 wherein said die is for said top portion having a conical shape.

11. The device of claim 4 wherein said die is for said top portion having a flap.

12. The device of claim 4 additionally comprising:

a mount for said die connected to said third movable arm, wherein said die is removable from said mount.

13. The device of claim 12 wherein said mount fits at least one additional die.

14. A device for assembling a roof fitment, said device in a machine frame, said device comprising:

a seal-forming cone mounted on a first movable arm to said machine frame;

a vacuum plate, adapted to hold a base portion of a boot for said roof fitment, mounted on a second movable arm to said machine frame;

a heat conductive plate movably mounted to a support rail on said machine frame;

a heating element in thermal contact with said heat conductive plate;

a die mounted on a third movable arm, said die adapted to hold a top portion of the boot; and a sliding assembly mounted to said third movable arm and movable alone a guide rail on said machine frame, wherein said seal forming cone is inserted into said die to cold form a bottom edge on said top portion, said die moves along said guide rail to a position under said heat conductive plate, said third movable arm extends to position said cold-formed bottom edge against a first side of said heat conductive plate, said second movable arm extends to position said base portion against a second side of said heat conductive plate, said heating element transfers heat to heat said top portion and said base potion sufficiently to allow bonding said portions of said boot together, said second movable arm and said third movable arm retract to respective positions slightly away from said sides of said heat conductive plate, said heat conductive plate moves on said support rail from a position between said portions of said boots, a bottom opening on said top portion and a base opening on said base portion are aligned by said third movable arm and said second movable arm, respectively, and at least one of said movable arms extends to place at least said heated portions of said boot into contact to allow heat bonding of said heated portions of said boot together.

15. The device of claim 14 additionally comprising:

a mount for said die connected to said third movable arm, wherein said die is removable from said mount.

16. The device of claim 14 wherein said die is connected to a source of vacuum for holding said top portion within said die.

17. The device of claim 14 wherein said die has a lip having a shape complementary to said cold formed bottom edge of said top portion.

18. The device of claim 17 wherein said lip is connected to a source of vacuum to position said cold formed bottom edge of said top portion.

19. The device of claim 14 wherein said heating element is appropriately shaped to match a desired portion of said top portion and said base portion to be bonded together.

* * * * *

UNITED STATES PATENT AND TRADEMARK OFFICE

CERTIFICATE OF CORRECTION

PATENT NO. : 6,892,782 B1
DATED : May 17, 2005
INVENTOR(S) : Mayle

It is certified that error appears in the above-identified patent and that said Letters Patent is hereby corrected as shown below:

Column 10,
Line 30, please delete "potion" and insert -- portion --.

Column 13,
Line 4, please delete "alone" and insert -- along --.

Signed and Sealed this

Sixteenth Day of August, 2005

JON W. DUDAS
*Director of the United States Patent and Trademark Office*